US005813457A

United States Patent [19]

Giroux et al.

[11] Patent Number: 5,813,457

[45] Date of Patent: Sep. 29, 1998

[54] WELLBORE CEMENTING SYSTEM

[75] Inventors: Richard L. Giroux, Katy, Tex.; Peter Budde, Vlaardigen, Netherlands

[73] Assignee: Weatherford/Lamb, Inc., Houston, Tex.

[21] Appl. No.: 704,994

[22] Filed: Aug. 29, 1996

Related U.S. Application Data

[63] Continuation-in-part of Ser. No. 429,763, Apr. 26, 1995, Pat. No. 5,553,667.

[51] Int. Cl.[6] ..... E21B 33/16

[52] U.S. Cl. ..... 166/153; 166/155; 166/177.4

[58] Field of Search ..... 166/156, 70, 291, 166/72, 153, 154, 285, 155, 177.4

[56] References Cited

U.S. PATENT DOCUMENTS

| | | | |
|---|---|---|---|
| 2,620,037 | 12/1952 | McClendon | 166/14 |
| 2,630,179 | 3/1953 | Brown | 166/155 |
| 3,545,542 | 12/1970 | Scott | 166/155 |
| 3,616,850 | 11/1971 | Scott | 166/155 |
| 3,635,288 | 1/1972 | Lebourg | 166/156 |
| 3,796,260 | 3/1974 | Bradley | 166/153 |
| 3,863,716 | 2/1975 | Streigch | 166/70 |
| 3,915,226 | 10/1975 | Savage | 166/73 |
| 3,926,253 | 12/1975 | Duke | 166/70 X |
| 3,971,436 | 7/1976 | Lee | 166/70 |
| 4,047,566 | 9/1977 | Duke | 166/285 |
| 4,078,810 | 3/1978 | Arendt | 277/116.4 |
| 4,083,074 | 4/1978 | Curtis | 15/104.06 X |
| 4,164,980 | 8/1979 | Duke | 166/291 |
| 4,190,112 | 2/1980 | Davis | 166/291 |
| 4,246,967 | 1/1981 | Harris | 166/291 |
| 4,290,482 | 9/1981 | Brisco | 166/70 |
| 4,356,865 | 11/1982 | Appel et al. | 166/153 |
| 4,427,065 | 1/1984 | Watson | 166/250 |
| 4,429,746 | 2/1984 | Allard | 166/291 |
| 4,433,859 | 2/1984 | Driver et al. | 285/34 |
| 4,453,745 | 6/1984 | Nelson | 285/18 |
| 4,457,369 | 7/1984 | Henderson | 166/125 |
| 4,624,312 | 11/1986 | McMullin | 166/155 |
| 4,753,444 | 6/1988 | Jackson et al. | 277/230 |
| 4,809,776 | 3/1989 | Bradley | 166/153 |
| 4,836,279 | 6/1989 | Freeman | 166/153 |
| 4,858,687 | 8/1989 | Watson et al. | 166/153 |
| 4,917,184 | 4/1990 | Freeman et al. | 166/285 |
| 4,934,452 | 6/1990 | Bradley | 166/153 |
| 4,986,361 | 1/1991 | Mueller et al. | 166/381 |
| 5,004,048 | 4/1991 | Bode | 166/70 |
| 5,025,858 | 6/1991 | Glaser | 166/156 |
| 5,078,211 | 1/1992 | Swineford | 166/202 |
| 5,095,980 | 3/1992 | Watson | 166/192 |
| 5,113,940 | 5/1992 | Glaser | 166/153 X |
| 5,117,915 | 6/1992 | Mueller et al. | 166/381 |
| 5,178,216 | 1/1993 | Giroux et al. | 166/242 |
| 5,224,540 | 7/1993 | Streich et al. | 166/118 |
| 5,246,069 | 9/1993 | Glaser et al. | 166/153 X |

(List continued on next page.)

FOREIGN PATENT DOCUMENTS

| | | |
|---|---|---|
| 88/308096.2 | 1/1988 | European Pat. Off. . |
| 95/305768.4 | 8/1995 | European Pat. Off. . |
| 2115860 | 2/1983 | United Kingdom . |

OTHER PUBLICATIONS

"Casing Sales Manual," Halliburton, Section 3 –5, 1993.
"Fasdrop Head," LaFleur Petroleum Services, Inc. 1992.
PCT/GB96/01007 Int'l Search Report in foreign application re parent of present US case.

*Primary Examiner*—Frank Tsay
*Attorney, Agent, or Firm*—Guy McClung

[57] ABSTRACT

A new wellbore cementing system has been developed which includes, in certain embodiments, a plug container with a flow diverter for diverting a portion of flowing fluid away from plugs in the plug container; a plug set system with internal sleeves or dart receivers with shearable parts for shearing to selectively release plugs—all in certain embodiments made of non-metal material and/or plastic; a swivel equalizer with internal valving to isolate a plug set (or any other item) from torque and to relieve pressure below the swivel equalizer; and unique burst tube systems for selectively controlling fluid flow and plug system operation.

12 Claims, 15 Drawing Sheets

U.S. PATENT DOCUMENTS

| | | | |
|---|---|---|---|
| 5,279,370 | 1/1994 | Brandell et al. | 166/386 |
| 5,392,852 | 2/1995 | Laurel et al. | 166/153 |
| 5,413,172 | 5/1995 | Laurel | 166/153 |
| 5,433,122 | 7/1995 | Brisco | 166/285 |
| 5,433,270 | 7/1995 | La Fleur | 166/152 |
| 5,435,390 | 7/1995 | Baugh et al. | 166/285 |

WELLBORE CEMENTING SYSTEM

RELATED APPLICATION

This is a continuation-in-part of U.S. application Ser. No. 08/429,763 filed on Apr. 26, 1995, U.S. Pat. No. 5,553,667, entitled "Cementing System" co-owned with the present invention.

BACKGROUND OF THE INVENTION

1. Field of the Invention

This invention is directed to wellbore cementing systems; plug set release systems; plug containers; and swivel equalizers for well tools and apparatuses.

2. Description of Related Art

During the construction of oil and gas wells a bore is drilled into the earth. Casing is then lowered down the bore and the annular space between the outside of the casing and the bore is filled with cement. The casing is centered in the bore by centralizers. Typically, a non-return valve, a "float valve," is mounted on or adjacent the bottom of the casing. During a typical cementing operation the annular space is first cleared by pumping circulating fluid down the inside of the casing and allowing it to flow upwardly through the annular space, then a bottom plug is placed in the casing. The bottom plug is pumped ahead of cement to separate the cement from drilling mud and other wellbore fluids and typically has wipers of elastomeric material to wipe mud from the casing so it does not contaminate the cement. The plug contacts float equipment at the bottom of the casing string. Fluid pressure ruptures a rupturable member of the plug and cement flows through the plug and float equipment, and up into an annular space. When the cement flow ceases, a top cementing plug is released which follows the cement and reduces contamination or channeling of the cement by drilling mud that is used to displace the cement column down the casing and into the annular space. The top cementing plug sealingly contacts the bottom cementing plug at the float equipment to effect a shut off of fluids being pumped into the casing. The return flow of cement back into the casing in inhibited by the float valve. When the cement has set the top plug, bottom plug, float valve and residual cement are drilled out.

Typically, plug containers or cementing heads connected to the upper end of the casing string releasably hold cementing plugs until they are to be released ahead of and behind the cement as it is displaced through the cementing head into the well casing. Many prior art plug set systems are complex with many moving parts, some of which are exposed to the corrosive fluids flowing up and down in the wellbore. In cementing offshore wells drilled beneath a body of water, the plugs may be run into the wellbore with a casing string. A variety of problems are associated with such "sub sea" release systems; e.g. parts are eroded by sand, grit, and corrosive material in various fluids; positive indication of plug release is not achieved; plugs or parts of them are not made of easily drillable material; and ocean forces on casing extending from a drilling platform to a sub-sea wellhead bend and twist the casing, inhibiting or preventing the use of certain plugs.

This has led to the development of sub-sea cementing apparatus which generally comprises an open top plug and an open bottom plug which are releasably connected to one another. In use, the sub-sea cementing apparatus is positioned in the casing at or adjacent the sub-sea wellhead by a tool string. Circulating fluid is then pumped downwardly from the drilling platform through the tool string, the open top plug, the open bottom plug and the casing and flows upwardly through the annular space between the outside of the casing and the bore. This operation is typically carried out for several hours after which a first closure member, typically a ball or a dart, is dropped down the casing, passes through the top plug but closes the bottom plug. A required volume of cement is then pumped down from the drilling platform. This detaches the bottom plug from the top plug and forces the bottom plug to slide down the casing. Once the required volume of cement has been pumped into the casing a second closure member, typically a ball or a dart of larger diameter than the first dart is placed on the top of the cement and pumped down with drilling fluid. When the second closure member engages the top plug it closes the opening therein and further pressure from the drilling fluid releases the top plug down the casing. When the bottom plug engages the float valve at the bottom of the casing the pressure on the top plug is increased until a rupturable member in the bottom plug ruptures allowing the cement to pass through the float valve into the annular space between the outside of the casing and the bore. When the top plug engages the bottom plug the hydraulic pressure on the drilling fluid is released and the cement allowed to set after which the top plug, bottom plug, float valve and residual cement are drilled out.

The disadvantage with existing sub-sea equipment is that it has been extremely difficult to control the pressure at which the bottom plug is released and even more difficult to control the pressure at which the top plug is released. One very serious problem is when the pressure which has to be applied to release the bottom plug is so high that the top plug is simultaneously released thus severely delaying the cementing operation. Certain prior art sub-sea cementing apparatus is constructed primarily of aluminum and uses a multiplicity of shear pins to achieve release at desired pressures.

It is believed that aluminum is not the most suitable for certain sub-sea plug sets. Without wishing to be bound by any theory, the inventors believe that when existing sub-sea cement apparatus are maneuvered into position, relative movement between the parts of the apparatus causes small indentations in the surface of the aluminum which can form abutments which inhibit subsequent relative movement of parts at the desired pressure. Furthermore, the inventors believe that since, in practice, the fluid used during circulation often contains traces of sand and minute particles, these particles often become wedged between the parts of the apparatus, piercing or damaging the surface of the aluminum, and inhibiting relative movement of the parts.

Representative plug sets, plug containers, and release systems are shown in these U.S. Pat. Nos. : 5,392,852; 5,095,980; 5,004,048; 4,453,745; 4,433,859; 4,427,065; 4,290,482; 4,246,967; 4,164,980; 3,863,716; 3,635,288; 3,616,850; 3,545,542; and 2,620,037.

SUMMARY OF THE PRESENT INVENTION

The present invention, in one embodiment, discloses a well cementing system including a plug container with a flow diverter to direct fluid flow away from plugs therein; a swivel equalizer to isolate a plug set system from torque on drill pipe above the plug set system and to relieve fluid pressure above the plug set system; and a plug set system including a top cementing plug, a bottom cementing plug, and apparatus for releasably holding them and releasably holding them together. Such a system is usable with typical float equipment, float shoes, or float collars. In one aspect a single plug is used rather than a set of plugs.

The present invention provides in certain embodiments a sub-sea cementing apparatus which includes a bottom plug having an opening therein, a top plug having an opening therein, and apparatus for releasably holding the bottom plug and the top plug together: the top plug, the bottom plug and the apparatus made from a resilient material. In certain embodiments the resilient material is a plastic material; a fiberglass material; a combination thereof; or any easily drillable material, including but not limited to an easily drillable metal material or an easily drillable non-metal material.

It is, therefore, an object of at least certain preferred embodiments of the present invention to provide:

New, useful, unique, efficient, nonobvious devices and methods for wellbore cementing operations;

New, useful, unique, efficient, and nonobvious plugs and plug set systems for wellbore operations;

Such a plug or plug set system in which substantially all or all parts are made of easily drillable metal or non-metal material, in one aspect, plastic or fiberglass;

New, useful, unique, efficient, and nonobvious swivel equalizers for wellbore operations and, in one particular aspect, for use with plug set systems; and New, useful, unique, efficient and nonobvious plug or dart containers for holding and selectively releasing a dart or darts, or a plug or plugs into a wellbore which, in one aspect, have a flow diverter to divert fluid flow away from a dart or darts, or a plug or plugs in the container.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
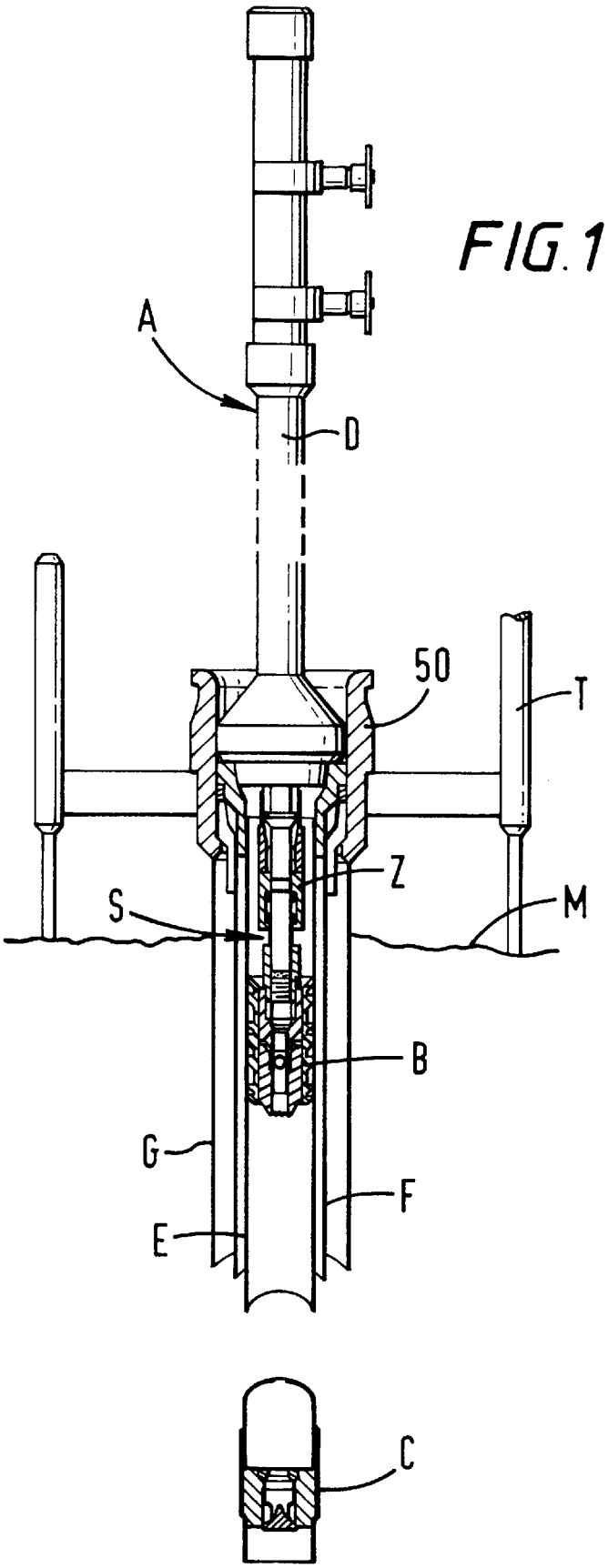
FIG. 1 is a side view in cross-section of a cementing system according to the present invention.

FIG. 1 illustrates a cementing system S according to the present invention which includes a plug container system A according to the present invention; a swivel equalizer Z according to the present invention; and a plug set system B according to the present invention within an innermost casing E within an internal casing F in an outer casing G. Float equipment C (e.g. but not limited to, any known float equipment, float collar or float shoe) is mounted at the bottom of the casing. Drill Pipe D extends from the plug container system A, to and through a casing hanger 50 in a sub-sea template T at the mud line M. In one embodiment the float equipment is as described in pending U.S. application Ser. No. 08/215,095 filed Mar. 18, 1994 entitled "Valve"; and in one embodiment the float equipment is as described in pending U.S. application Ser. No. 08/283,404 filed Aug. 1, 1994 entitled "Fill Valve". Both these applications are co-owned with the present invention and are incorporated fully herein for all purposes.

Figure 2:
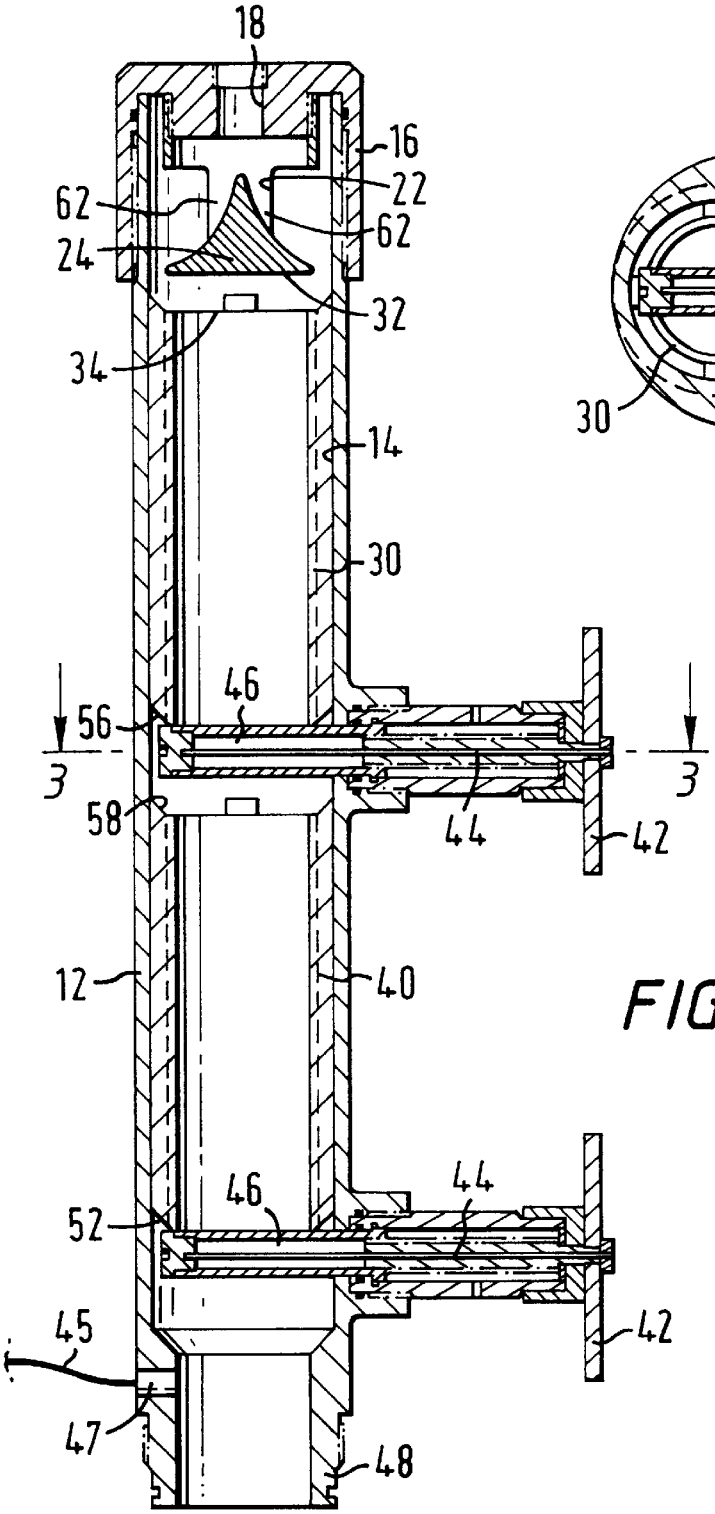
FIG. 2 is a side view in cross-section of a plug container according to the present invention.
Figure 3:
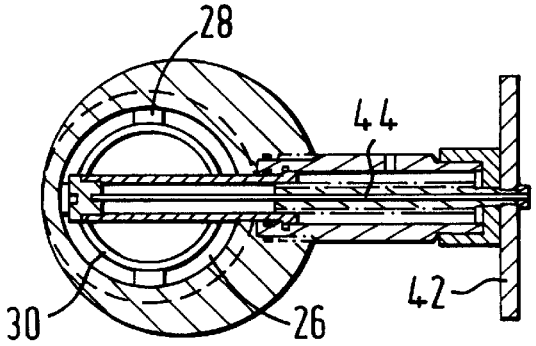
FIG. 3 is a top cross-section view along line 3—3 of FIG. 2.
Figure 4A:
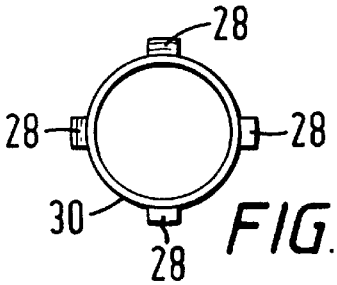
FIG. 4*a* is a top view of a spool of the device of FIG. 2.
Figure 4B:
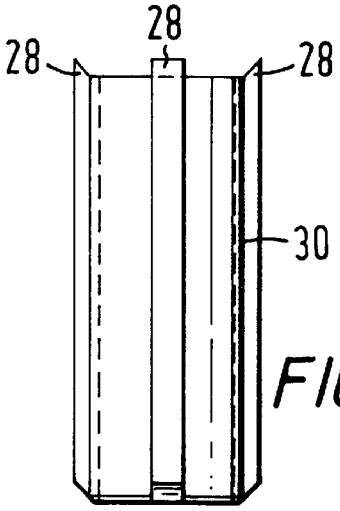
FIG. 4*b* is a side view of the spool of FIG. 4*a*.
Figure 5A:
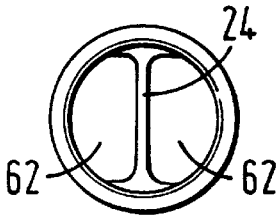
FIG. 5*a* is a top view of a diverter of the device of FIG. 2.
Figure 5B:
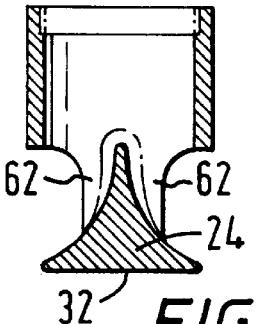
FIG. 5*b* is a side view in cross-section of the diverter of FIG. 5*a*.

FIG. 2 shows a plug container A which has a main body 12 with a bore 14 therethrough and a top cap 16 with a bore 18 therethrough. Fluid, e.g. displacement fluid, is flowable through the bore 18 of the cap 16 to enter into a bore 22 of a fluid diverter 20. The fluid contacts a diverter body 24 which directs the fluid away from the center of a top spool 30 and into spaces 26 between ribs 28 of the top spool 30 (see FIG. 3) and the interior surface of the container. The top spool 30 holds a top dart (not shown in FIG. 2) for selective release and movement downhole to activate a top plug as described below.

A bottom 32 of the diverter body 24 in certain preferred embodiments preferably extends across and above a substantial amount of an upper opening 34 of the top spool 30, most preferably above about 80% of the total opening area. Diverted fluid does not adversely impact or affect a dart disposed in the top spool 30 or in a bottom spool 40.

Darts in the spools are released by manually or automatically turning a handwheel 42 attached to an inner threaded shaft 44 which results in the extraction from within the body 12 of a plunger 46 which blocks downward spool movement. A crossover sub 48 may be used to interconnect the plug container A with drill pipe D (FIG. 1) or with some other tubular.

In certain embodiments the plug container A is provided with a sensor 47 which senses a dart or plug as it passes the sensor, generating a signal which is transmitted to associated apparatus to positively indicate dart or plug launch. In one aspect such a sensor is a magnetic sensor and an appropriate piece, insert, or band of magnetic material is applied on, around, or in the dart or darts, plug or plugs to be released from the container. In one aspect the sensor is disposed in or through the crossover sub 48 with appropriate wiring 45 extending therefrom to signal processing/display apparatus.

In operation, the bottom spool 40 is released by turning a handwheel 42 to remove a plunger 46 holding the spool in place. A lower sealing surface 52 of the bottom spool 40 moves to contact a sealing surface 54 of the crossover sub. Upon impact of spool 40 on the sealing surface 54, a bottom dart (not shown) in the spool 40 is released to move downhole to contact and co-act with a bottom plug of a plug set as described below. As and when desired, a handwheel 42 is turned to extract a plunger 46 which supports the top spool 30, permitting the top spool 30 to move down to impact the bottom spool 40, thereby releasing a top dart (not shown) to travel through the bottom spool to move downhole to contact and co-act with a top plug of a plug set as described below. A sealing surface 56 on a bottom of the top spool 30 seals against a sealing surface 58 on a top of the bottom spool 40.

Flow diversion by the diverter body 24 into windows 62 of the diverter 20 inhibits the creation of a fluid pressure overload on the plungers 46 and reduces the possibility of a premature dart launch. Overloading on the plungers 46 could distort them and/or inhibit their movement, thereby inhibiting or preventing dart release.

Figure 6:
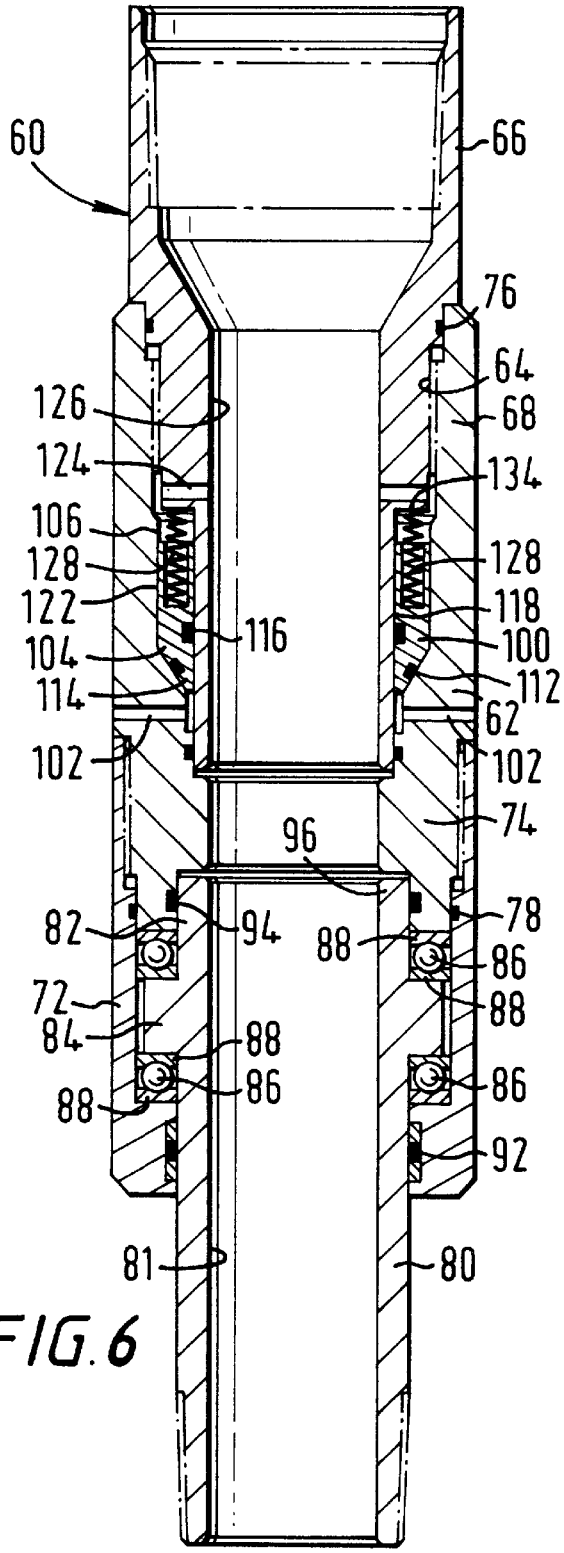
FIG. 6 is a swivel equalizer according to the present invention.

Connected to an end of the drill pipe D at one end and to a plug set system at the other end is the swivel equalizer Z according to the present invention. As shown in FIG. 6, in one embodiment the swivel equalizer Z is a swivel equalizer 60 with a middle body 62 with a bore 64 therethrough. A top sub 66 with a bore 126 therethrough is threadedly connected to a top end 68 of the middle body 62. A bearing housing 72 is threadedly connected to a bottom end 74 of the middle body 62. A seal 76 (e.g. O-ring) seals the interface between the top sub 66 and the middle body 62. A seal 78 seals the interface between the middle body 62 and the bearing housing 72. A pin sub 80 is rotatably mounted with a top end 82 within the bearing housing 72 with a ring 84 which rides on ball bearings 86 mounted in bearing races 88. A seal 92 seals the interface between the pin sub 80 and the bearing housing 72. In one aspect the seal 92 includes an O-ring and a metal or Teflon (™) backup member above and below the seal. A seal 94 seals the interface between a top 96 of the pin sub 80 and the middle body 62. The pin sub 80 has a bore 81 and interconnects with a plug set system B below the pin sub 80 so that the plug set B is isolated from torque imposed on the swivel equalizer 60 since the pin sub 80 is free to rotate within the bearing housing 72 on the ball bearings 86. The swivel equalizer may be used with any other device, apparatus, or tool in a wellbore or in a tubular and/or on coiled tubing, including, but not limited to, use with a liner hanger. Darts are movable down through the swivel equalizer 60—through the bore 126, the bore 64, and a bore 81—to contact and co-act with plugs of a plug set system.

Figure 7:
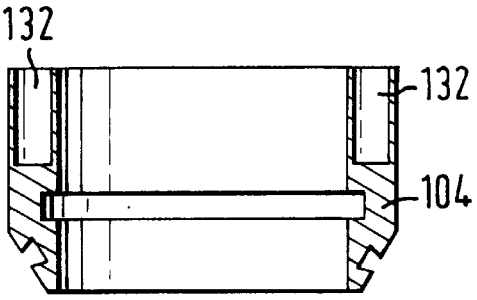
FIG. 7 is a side cross-section view of a valve member of the device of FIG. 6.
Figure 8:
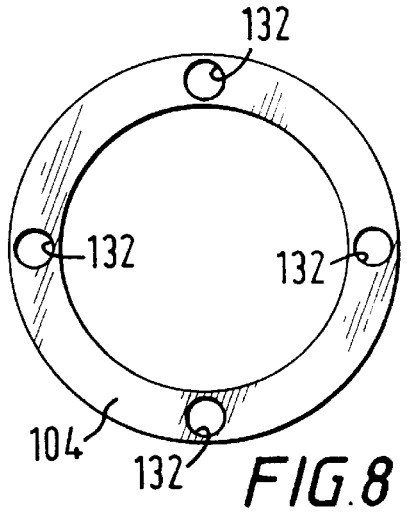
FIG. 8 is a top view of the valve member of FIG. 7.

To relieve and/or equalize the pressure of fluid above and/or adjacent the plugs of a plug set such as plug set B, (e.g. in the event a high pressure fluid is trapped by fins of the plugs which could force the plugs apart and result in a premature release) such trapped fluid under pressure flows through a port (or ports) 102 to contact a valve member 104 of a valve 100 disposed in a chamber 106 defined by an exterior surface 118 of a bottom 108 of the top sub 66 and an interior surface 122 of the middle body 62. A seal 112 which sealingly abuts an inner surface 114 of the middle body 62 is, in one embodiment larger than a seal 116 which sealingly abuts the surface 118 of the bottom 108 of the top sub 66 so that, when the pressure of fluid flowing into the port 102 is at a sufficient level, e.g. about 10 p.s.i. or greater, the valve member 104 is moved upwardly permitting the fluid to flow from above the plugs past the valve member 104, to and through a port 124, and into the bore 126 of the top sub 66. Initially springs 128 oppose the pressure of fluid (e.g. drilling mud, circulating fluid, wash fluid, completion fluid) flowing into the port 102 and prevent the valve member 104 from moving. As shown in FIGS. 7 and 8 the springs 128 are disposed in holes 132 in the valve member 104. Tops of the springs 128 abut a shoulder 134 of the top sub 66. Fluid flowing in the opposite direction will push on the valving member and flow through the port 102 will be shut off. Use of such a swivel equalizer allows the casing hanger to be made up without rotating the plugs inside the casing.

Figure 10:
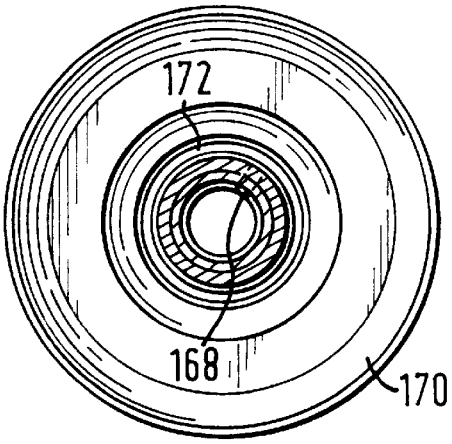
FIG. 10 is a cross-section view along line 10—10 of FIG. 9.
Figure 9:
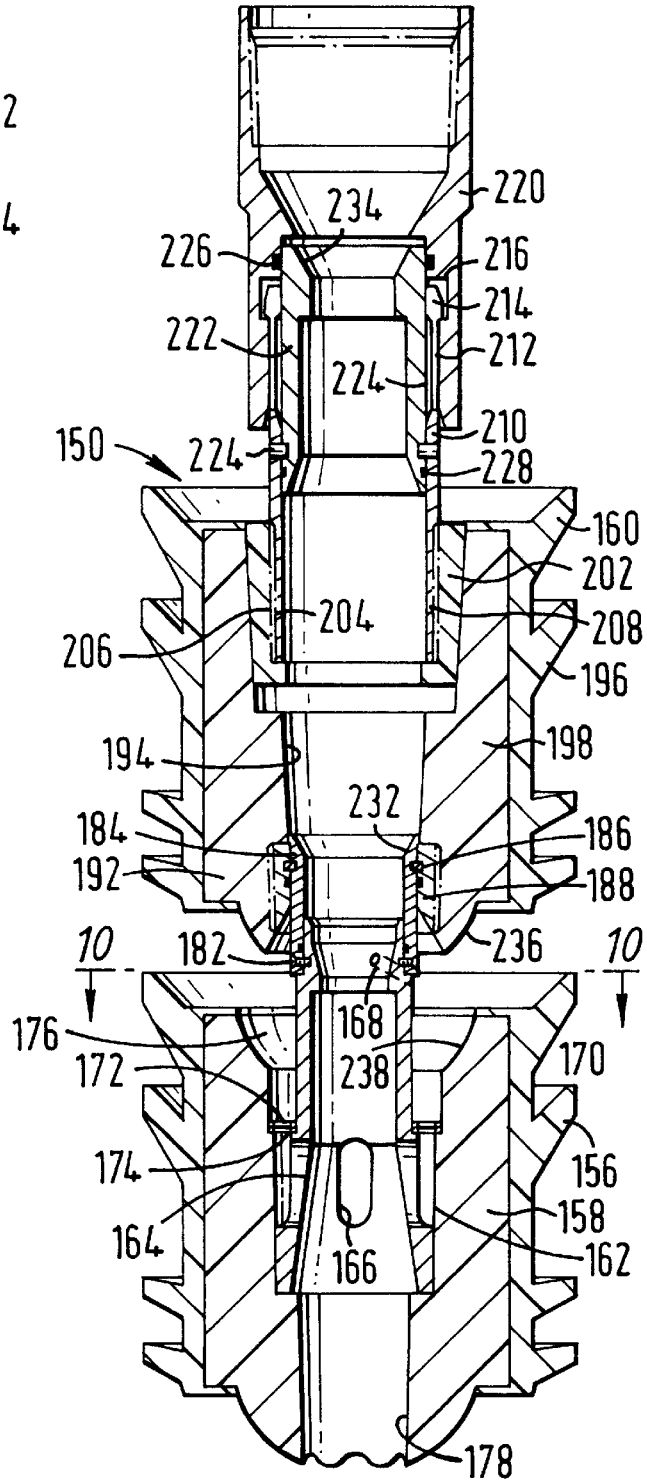
FIG. 9 is a side cross-section view of a plug set system according to the present invention.

FIGS. 9 and 10 show a plug set 150 with a top plug 160 and a bottom plug 170 which is one embodiment of a plug set B (FIG. 1) according to the present invention.

The bottom plug 170 has a finned exterior 156, a core 158, and a bore 162 therethrough. Disposed in the bore 162 is a flow piece 164 with one or more fluid flow windows 166 therethrough. The flow piece 164 has a pressure equalization hole 168 extending from the flow piece interior bore to the plug exterior for equalizing fluid pressure, if necessary, for fluid trapped by or between the two plugs. (Such a hole or holes may be provided for any plug or plug set according to this invention.) A burstable doughnut seal 172 is disposed on a shoulder 174 of the plug 170. Initially the seal 172 prevents fluid from flowing through a top bore 176 of the plug 170 to the windows 166 and thence out through a bottom opening 178 of the plug 170.

The flow piece 164 is shear pinned by shear pins 182 to a connector 184 which is secured by a shearable lock ring 186 to an insert 188 (made, in one aspect, of aluminum). The insert 188 is threadedly secured in a lower portion 192 of a bore 194 of the top plug 160. The lock ring 186 shears in response to the top plug 160 landing on the bottom plug 170.

The top plug 160 has a finned exterior 196 and an inner core 198 through which extends the bore 194. A core piece 202 (made, in one aspect, of plastic) is secured in a core 198 (e.g. by glue, other adhesives, a friction fit, ultrasonic welding or a threaded mating of the two pieces) and has a bore 204 therethrough and a threaded interior surface 206 for threadedly mating with a lower end 208 of a collet member 210. The collet member 210 (e.g. made of aluminum or plastic) has one or more (in one embodiment eight) collet fingers 212 with tips 214 held in a recess 216 in a top sub 220. A releasing sleeve 222 within a bore 224 of the top sub 220 prevents the collet fingers 212 from moving inwardly which prevents the collet member from being released from the top sub 220, thereby preventing the top plug 160 from being released from the top sub 220. The releasing sleeve 222 is shear pinned to the collet member 210 by one or more shear pins 224 which, in one embodiment, shear at e.g. about 2400 to about 2600 p.s.i. pressure. A seal 226 seals the interface between the releasing sleeve 222 and the top sub 220. A seal 228 seals the interface between the releasing sleeve 222 and the collet member 210.

In operation a bottom dart (not shown in FIG. 9) is released from a plug container A and travels down through the drill pipe D, through the swivel equalizer 60, through the top sub 220, through the releasing sleeve 222, and through the top plug 160, so that a tail portion of the bottom dart sealingly seals against a seal surface 232 of the connector 184. As subsequent fluid pressure builds up on the bottom dart, the pressure reaches a sufficient level (e.g. about 1500 to about 1700 p.s.i. pressure) to effect shearing of the lock ring 186, thereby effecting release of the bottom plug 170 from the top plug 160. The bottom plug 170 once freed, moves down hole typically ahead of cement to contact and co-act with the float equipment C. In order to flow fluid, e.g. cement out through the bottom plug 170 and through the float equipment C up into an annulus between an interior wellbore surface and an exterior of a tubular in which the float equipment is mounted, the fluid is pumped with sufficient pressure to burst the seal 172 (e.g. about 400 p.s.i. pressure), permitting fluid to flow down through the bore 176, to and through the windows 166, out through the bottom opening 178, and into the float equipment C.

To release the top plug 160 to plug the bottom plug 170 and stop cement flow, a top dart is released (e.g. from a top spool in the device of FIG. 2) which moves down so that its nose contacts and sealingly abuts a seal surface 234 on the releasing sleeve 222. When fluid pressure on the top dart reaches a desired level (e.g. about 2400 to about 2600 p.s.i. pressure) the shear pins 224 holding the releasing sleeve 222 to the collet member 210 are sheared and the releasing sleeve is pushed down by the top dart thereby freeing the collet fingers 212 for inward movement which results in the release of the top plug 160 from the top sub 220. The top plug 160 then moves down to contact the bottom plug 170. A nose 236 of the top plug 170 contacts and sealingly abuts a corresponding recess 238 in a top of the bottom plug 160. Preferably all or substantially all of the bottom dart (a "tail operated dart") is received within the bottom plug.

In certain preferred embodiments anti-rotation apparatus is used on plugs and/or float equipment according to this invention so that one does not rotate on and/or with respect to the other. In one aspect the plugs have corrugated noses and corresponding mating corrugated recesses for sealingly and non-rotatively mating with a corresponding corrugated nose; and float equipment has a corresponding corrugated mating recess like those disclosed in U.S. Pat. No. 5,390,736 issued on Feb. 21, 1995, entitled "Anti-Rotation Devices For Use With Well Tools," and co-owned with the present invention.

Figure 11:
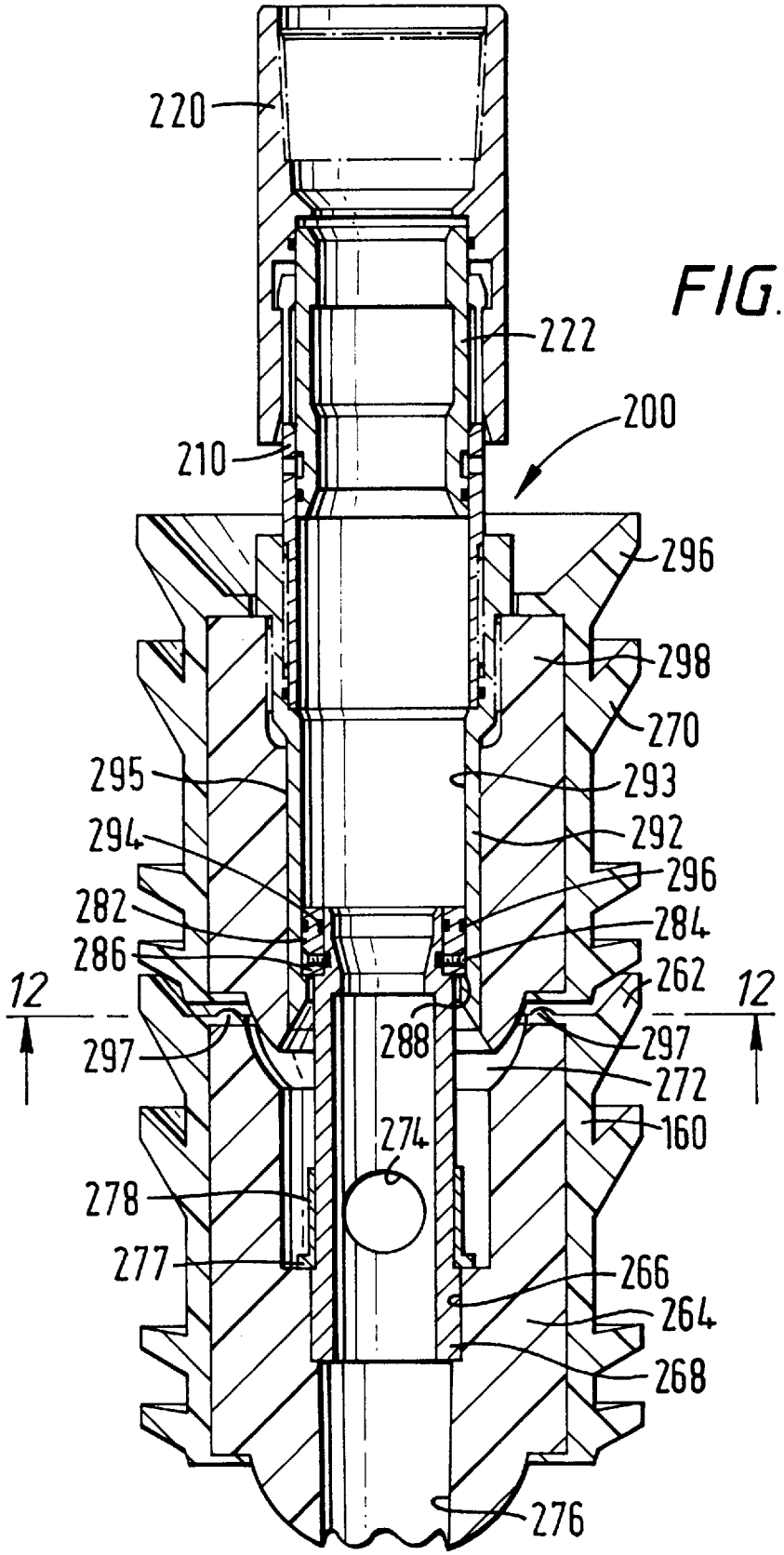
FIG. 11 is a side cross-section view of a plug set system according to the present invention.
Figure 12:
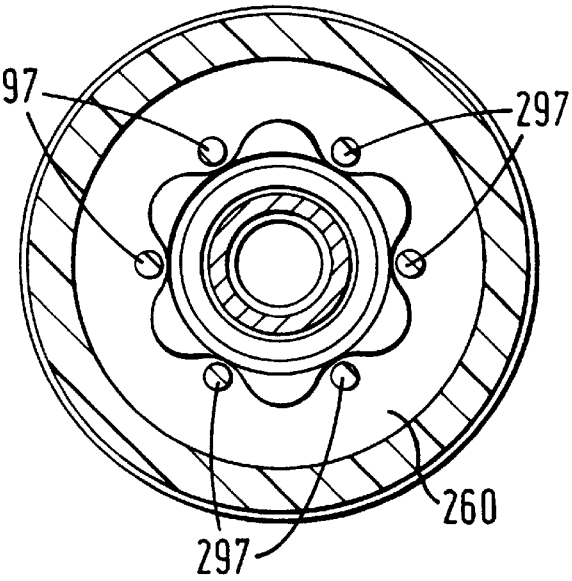
FIG. 12 is a top cross-section view along line 12—12 of FIG. 11.

FIGS. 11 and 12 disclose a plug set 200 similar to that of FIG. 9; but with various differences. A bottom plug 160 has a finned exterior 262; a core 264; a bore 266; and an inner flow piece 268. Initially fluid is prevented from flowing through a top bore 272 of the plug 260, to the bore 266, through one or more windows 274 in the flow piece 268, and out from a bottom opening 276 by a burstable tube 278 which blocks the window(s) 274. The tube 278 may be glued to the flow piece 268 or it may be held in place by a friction fit. A lower shoulder 277 on the burstable tube 278 facilitates proper emplacement of the tube 278. In other aspects the flow piece 268 is made as a single integral piece with a thinner and/or weakened area located at the desired location or locations for a window or windows.

The flow piece 268 (and hence the bottom plug 260) is releasably secured to a ring 282 by shear pins 284 which shear at, e.g. about 1500 to about 1700 p.s.i. pressure. The ring 282 has a lower end 286 which abuts an inner shoulder 288 of a core piece 292 (made of aluminum in one embodiment or of plastic in another). A seal 294 seals the interface between the flow piece 268 and the ring 282. A seal 296 seals the interface between the ring 282 and the core piece 292. In one aspect no glue is used on this plug set and all major parts are screwed together. The ring 282 is free floating in a bore 293 of the core piece 292. This facilitates swallowing by the top plug of a portion of the flow piece projecting from the bottom plug after the bottom plug is landed on float equipment. No part of the plug set moves (once the bottom plug is landed on the float equipment) for correct operation. The burstable tube bursts inwardly so that fluid flow downwardly is not impeded by tube parts projecting outwardly.

The core piece 292 is secured in a bore 295 of a top plug 270. The top plug 270 has a finned exterior 296 and a core 298. This embodiment employs the same collet member 210, releasing sleeve 222, and top sub 220 as the apparatus of FIG. 9.

FIG. 12 illustrates a plurality of spacer knobs 297 (e.g. soft rubber, polyurethane, or other flexible material) extending upwardly from the bottom plug 260 to initially maintain plug separation and prevent the two plugs from being in such close contact that a vacuum is formed between them which inhibits or prevents their separation (thereby preventing their launching).

Figure 14:
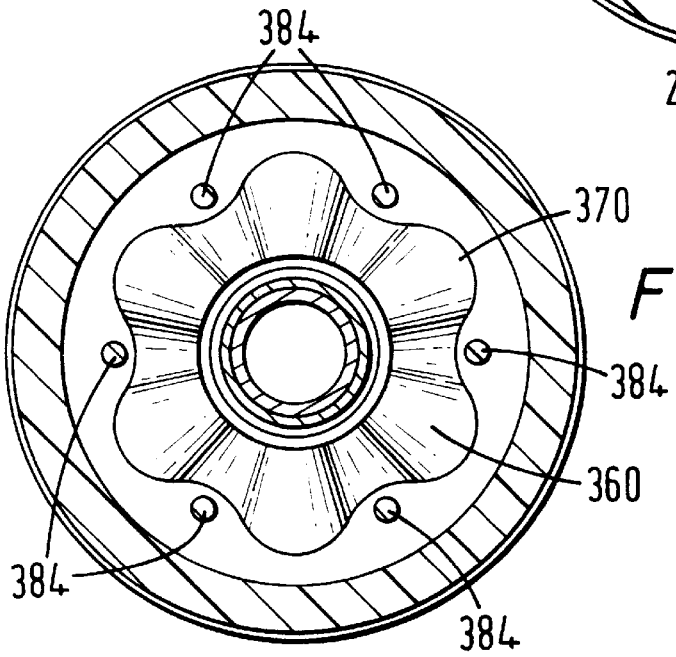
FIG. 14 is a top cross-section view along line 14—14 of FIG. 13.
Figure 13:
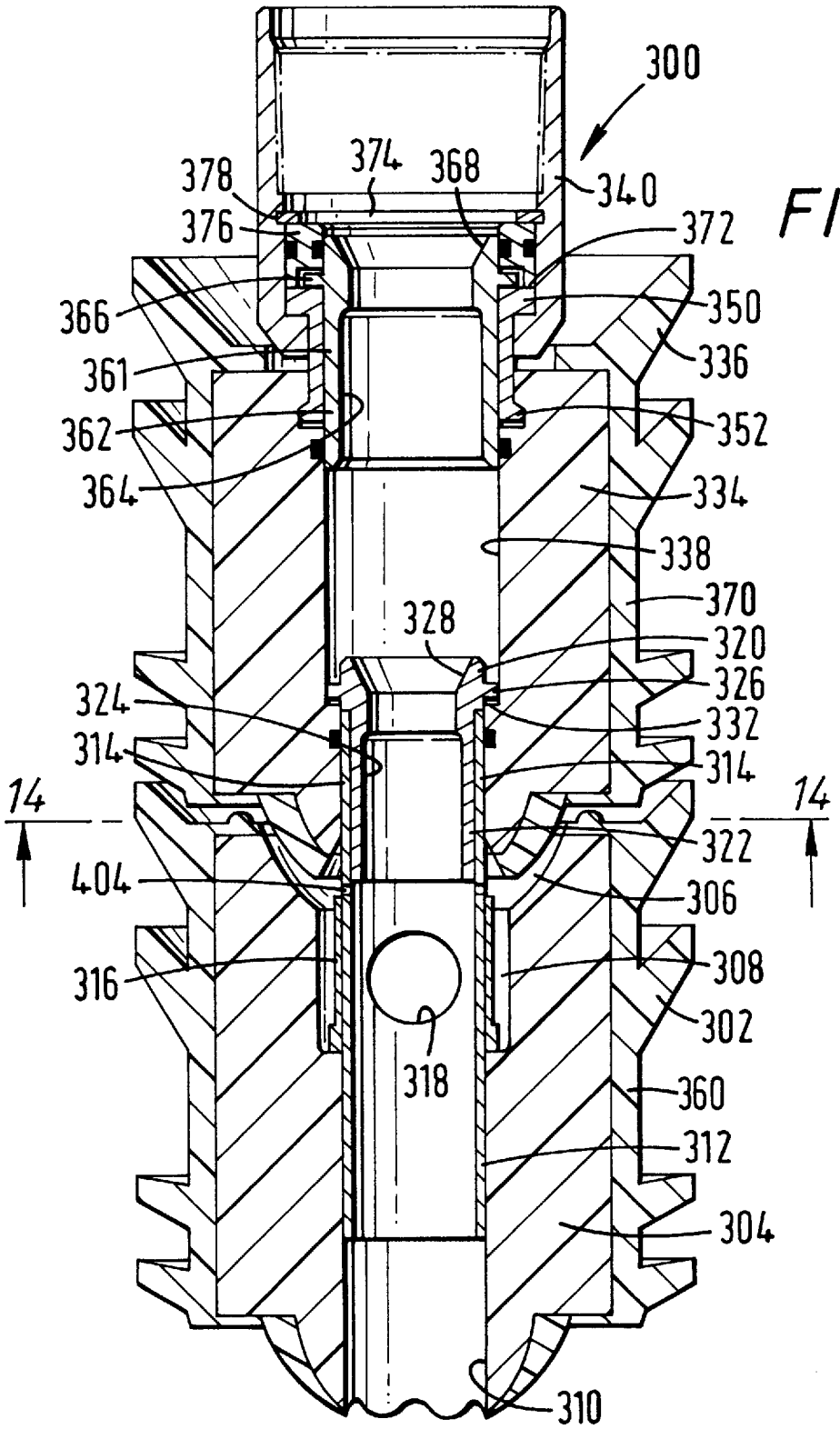
FIG. 13 is a side cross-section of a plug set system according to the present invention.

FIGS. 13 and 14 illustrate a plug set 300 according to the present invention which is useful as the plug set B in the system of FIG. 1. The plug set 300 has a bottom plug 360 with a finned exterior 302, a core 304, a top bore 306, a mid bore 308 and a lower bore 310. A flow piece 312 is secured in the bore 308 and/or to the flow piece 312 and a top portion 314 of the flow piece 312 is secured to a bottom dart receiver 320 which is initially disposed in a top plug 370. A burstable tube 316 initially prevents fluid from flowing through one or more windows 318 in the flow piece 312. The tube 316 may be glued to the flow piece 312 or it may be a friction fit over it. The windows may be of any desired shape (rectangular, oval, square, circular, etc.) and positioned as desired on the flow piece.

The bottom dart receiver 320 has a body 322, a bore 324, a shear ring 326 and a seal surface 328. The shear ring 326 initially rests on an inner shoulder 332 of a core 334 of a top plug 370. The plug 370 has a finned exterior 336 and bore 338.

The top plug 370 is releasably held to a top sub 340 by a collet member 350. A releasing sleeve 361 initially prevents collet fingers 352 from moving inwardly to release the top plug 370 from the top sub 340. The releasing sleeve 361 has a body 362, a bore 364, a shear ring 366, and a seal surface 368. The shear ring 366 rests on a top surface 372 of the collet member 350. A lock ring 374 in a groove 378 in a top sub 382 holds in place a holding ring 376 which holds the collet member 350 in place.

As shown in FIG. 14, spacer knobs 384 (e.g. made of soft plastic) maintain a minimum space between the two plugs to prevent vacuum formation therebetween.

Figure 15:
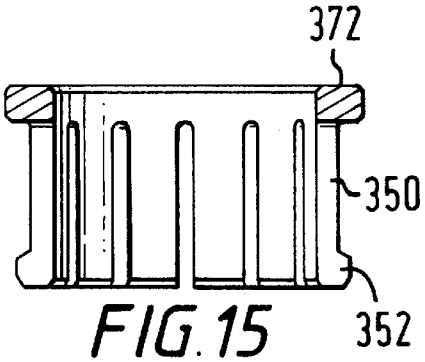
FIG. 15 is a side cross-section view of a collet member of the device of FIG. 13.
Figure 16:
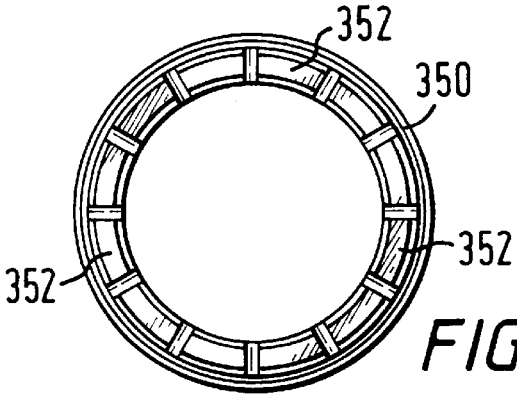
FIG. 16 is a bottom view of the device of FIG. 15.

In one embodiment the collet member 350 is a single piece member with a plurality of collet fingers 352 (see FIGS. 15, 16) which remains in the top sub rather than going down with the top plug. A clearance space 327 between a lower surface of the fingers and a shoulder 329 of the core 334 provide space in which the collet fingers move inwardly from the core 334. Due to an angled surface 331 on the core 334 and a corresponding angled surface 333 on the collet fingers 352, downward motion of the top plug 370 results in an inward force on the collet fingers 352 once the releasing sleeve 361 moves to free the collet fingers 352. In one aspect the collet member is made so that the collet fingers are biased inwardly. The releasing sleeve 361 may have a knife edge 363 at the lower end of the body 362 to cut a portion of a dart, e.g. a rear fin.

Figure 17:
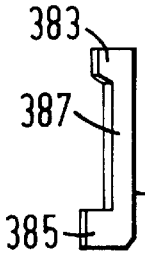
FIG. 17 is a side cross-section view of a collet member according to the present invention.
Figure 18:
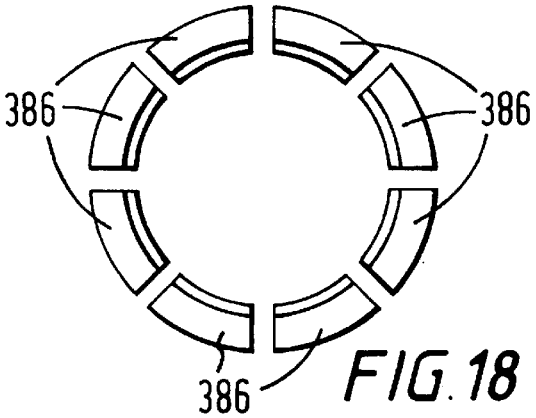
FIG. 18 is a top view of a plurality of collet members as in FIG. 17 in place in the device of FIG. 13.

In one aspect instead of integral shear rings (like the rings 326 and 366), it is within the scope of this invention to either adhere shear rings (of any cross-section, e.g. but not limited to circular, oval, square, rectangular, etc.), to a releasing sleeve's or dart receiver's exterior, or to provide a groove therein for receiving and holding a shear ring. In another embodiment, the collet member 350 is comprised of a plurality of individual pieces or "dogs" 386 (see FIGS. 17, 18). In such an embodiment a plurality of radial spaced stepped keyways each accommodate separate and distinct dogs. Each dog 286 is generally C-shaped having a vertical portion 287, a lower radially extending portion 385 which extends into a recessed portion of its respective stepped keyway, and an upper radially extending position 383 which extends over an inwardly extending flange portion of a connector which is connected to a tool string (not shown). The dogs 386 are maintained in the radially spaced stepped keyways by a sleeve which is generally similar to the sleeve 361 but of slightly greater internal diameter.

Figure 19:
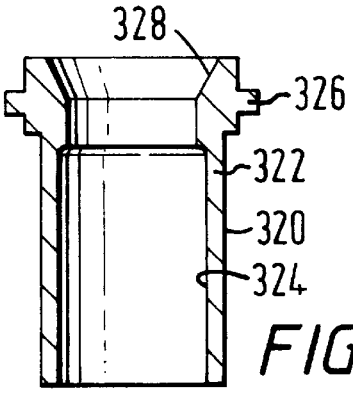
FIG. 19 is a side cross-section view of a bottom dart receiver of the device of FIG. 13.
Figure 20:
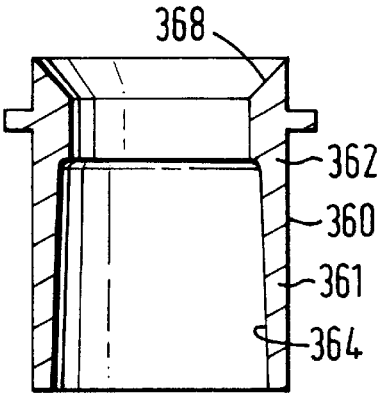
FIG. 20 is a side cross-section view of a top releasing sleeve of the device of FIG. 13.
Figure 21:
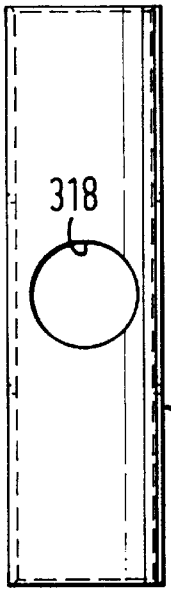
FIG. 21 is a side view of a flow piece of the device of FIG. 13.
Figure 22:
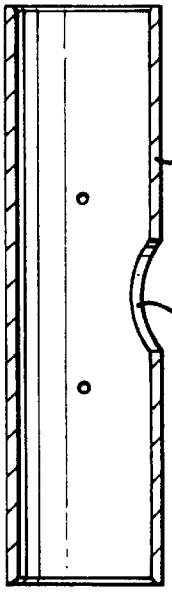
FIG. 22 is a side cross-section view of the flow piece of FIG. 21.
Figure 23:
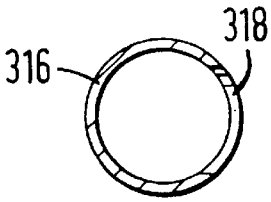
FIG. 23 is a top view of the flow piece of FIG. 21.

In one aspect such a system utilizes no shear pins, but relies on the use of the shear rings as described. In one embodiment the shear rings on the dart receivers are glued to the dart receivers. In one embodiment a bottom dart receiver 320 as shown in FIG. 19 has a shear ring which is formed integrally of the receiver body 322. In one aspect the bottom dart receiver is made of polycarbonate [e.g. LEXAN (™) material] and the shear ring is about 2 millimeters thick. In one aspect the bottom dart receiver is made of Riton (™) plastic and is about 3.5 millimeters thick. In one aspect the shear ring of the bottom dart receiver is designed, configured, and disposed to shear between 1500 and 1700 p.s.i. fluid pressure. In one aspect the releasing sleeve 360 (see FIG. 20) (which acts a top dart receiver) is made of Riton (™) plastic and the integral shear ring is designed, configured, and disposed to shear between 2400 to 2600 p.s.i. fluid pressure. In one aspect a burstable tube (e.g. tubes 278, 316) is made of in one aspect about 2 millimeters thick "PPS" or polyphenylene sulphide, [Riton (™) plastic is one commercial version of PPS.]

In operation, a tail operated bottom dart (or a ball may be used as with the other plug sets described above), lands on the bottom dart receiver; pressure builds up on the dart; and the shear ring of the bottom dart receiver is sheared allowing the bottom plug to move to the float equipment. The bottom plug lands on the float equipment and pressure builds up to a sufficient level to burst the bursting tube allowing cement to move to and through the float equipment to the annulus. The bottom dart receiver is glued to the flow tube and moves down with the bottom plug. Then when cement flow ceases, the "nose-operated" top dart is released shearing the shear ring on the releasing sleeve allowing the releasing sleeve to move down into the top plug, releasing the collet mechanism, and thereby releasing the top plug to move down to contact the bottom plug. The top plug swallows the flow tube extending upwardly from the bottom plug and, if used, anti-rotation apparatus on the two plugs goes into effect. A top fin of a bottom dart may be sheared at this time.

Figure 24:
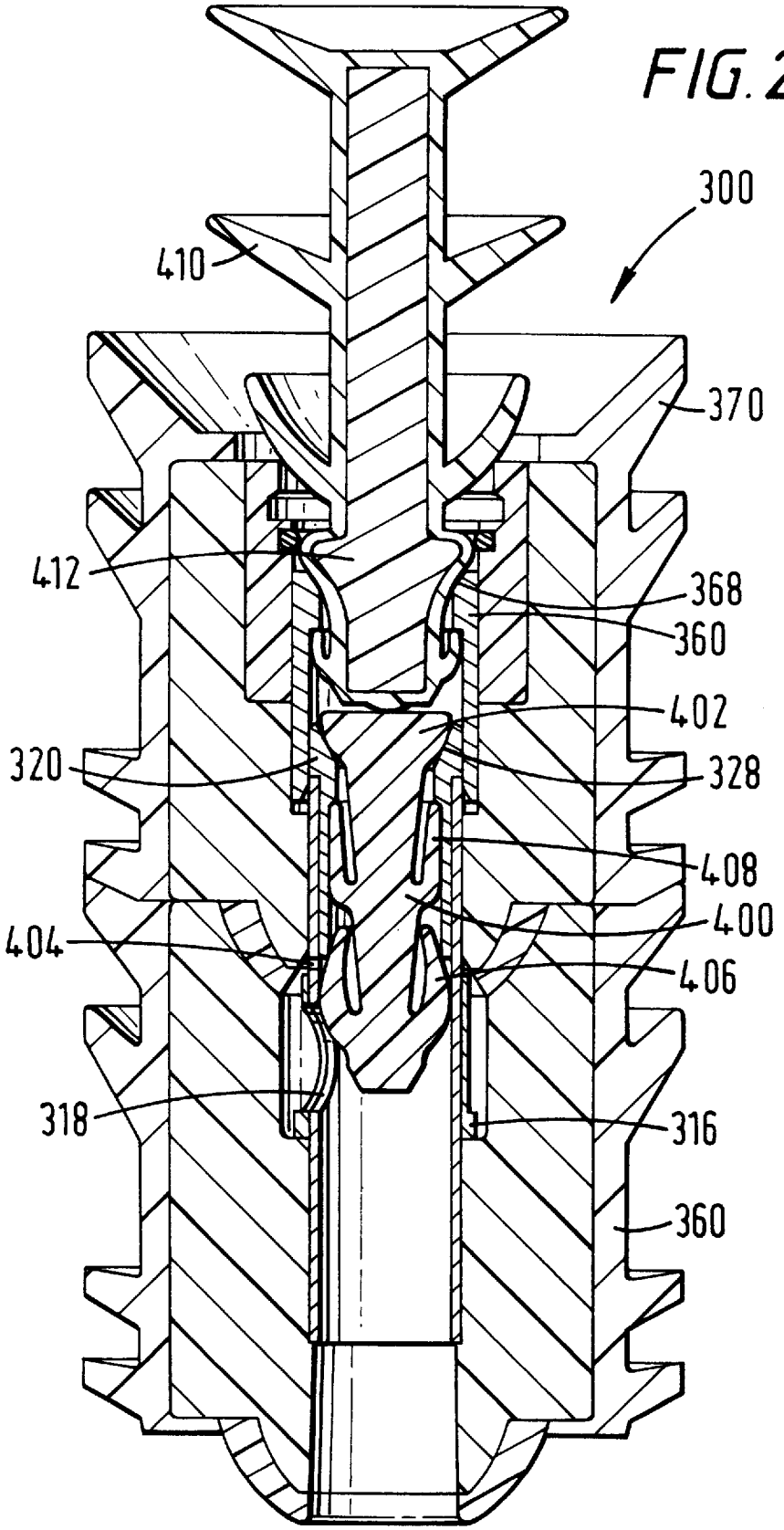
FIG. 24 is a side cross-section view of a plug set with darts according to the present invention.

FIG. 24 shows a plug set 300 according to the present invention post-launch; i.e., the plugs have been released from the plug container and are in position on top of float equipment C (not shown). A tail fin 402 of a bottom dart 400 has sealed against the seal surface 328 of the bottom dart receiver 320. The burstable tube 316 has burst inwardly at the window 318, opening it to fluid flow. The top plug 370 has been freed from the top sub and the plug 370 has moved to sealingly and anti-rotatively contact the bottom plug 360 (see, e.g. U.S. Pat. No. 5,390,736). A nose 412 of a top dart 410 has sealingly contacted the seal surface 368 of the releasing sleeve 360 and the sleeve 360 has moved down into the plug 370. As shown, a pressure equalization hole 404 through the flow piece 312 is effectively sealed by a bottom fin 406 and a top fin 408 so that flow out from the plug interior through the hole 404 is prevented.

Figure 25:
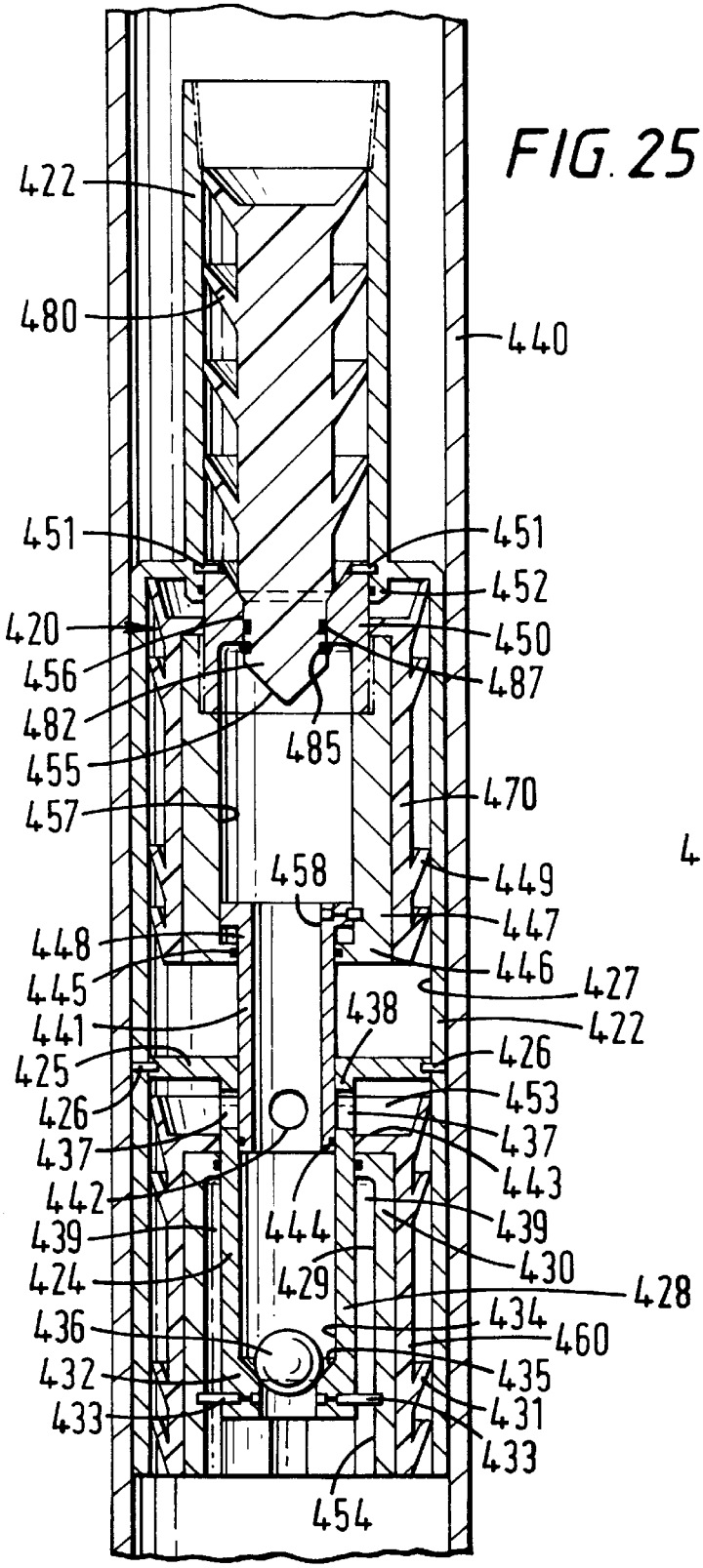
FIG. 25 is a side cross-section view of a plug set according to the present invention.
Figure 26:
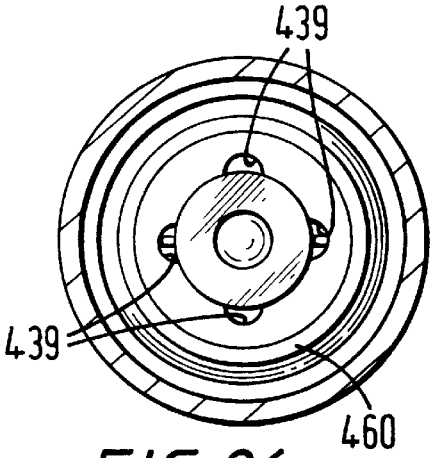
FIG. 26 is a cross-section view of a bottom plug of the plug set of FIG. 25.

FIGS. 25 and 26 show a plug set 420 according to the present invention with a bottom plug 460 and a top plug 470, each originally maintained in a plug holder or "can" 422 in casing 440. A bottom plug retainer 424 has a top plate 425 which is shear-pinned by pins 426 to an interior 427 of the can 422. The bottom plug retainer 424 has a descending cylindrical body 428 which extends down into a bore 429 of a core 430 of the bottom plug 460. The core 430 is within an outer finned structure 431 of the bottom plug 460. A lower portion 432 of the body 428 is shear-pinned by pins 433 to the core 430. An inner surface 434 of the body 428 has an inclined seal surface 435 suitable for sealingly contacting a ball 436 or a dart (not shown). Flow ports 437 are provided through an upper portion 438 of the body 428. Flow paths 439 are provided between an outer surface of the body 428 and an inner surface of the core 430.

A flow tube 441 with one or more flow windows 442 is disposed between the top plug 470 and the bottom plug 460. The flow window(s) 442 are disposed so that flow is possible through the window(s) 442, through the ports 437 and into a space 453 between the top plate 425 and a top 443 of the bottom plug 460. An O-ring 444 seals an interface between the interior of the flow tube 441 and the bottom plug retainer 424. An O-ring 445 seals an interface between a core end 446 of a core 447 of the top plug 470 and an upper portion 448 of the flow tube 441. The top plug 470 has an outer finned structure 449. (It is to be understood that the present invention may be used with a plug or plug sets which have no outer fins or wipers or one or more outer fins or wipers.) A top plug retainer 450 is shear-pinned by pins 451 to a top end 452 of the can 422. The top plug retainer 450 is secured in the core 447 of the top plug 470, e.g. by a tapered friction fit, but an adhesive, by mating threads, by ultrasonic welding, or some combination thereof.

As shown in FIG. 25, a ball 436 has been launched and landed on the seal surface 435 of the bottom plug retainer of the body 428. Fluid under pressure will then be pumped into the space 453. When sufficient pressure is reached, the shear pins 426 shear releasing the bottom plug 460 to more down the casing 440 to contact float equipment (not shown), leaving behind the flow tube 441. Upon landing and sealing of the bottom plug 460 on the float equipment, the pins 433 shear due to fluid pressure build-up, freeing the bottom plug retainer 424 to move downwardly so that the flow ports 437 move within the core 430 thereby opening a fluid flow path from above the bottom plug 460, through a bore 454 of the bottom plug retainer 424, through the ports 437, through the flow paths 439, and to and through the float equipment into the wellbore annulus.

Then a dart 480 is pumped down to the top plug 470 so that a nose 482 of the dart 480 seals against a seal surface 455 of the top plug retainer 450, closing off a flow bore 456 through the top plug retainer 450 and flow bore 457 through the top plug 470 and flow bore 458 through the flow tube 441. Fluid pressure build-up on the dart 480 shears the pins 451, releasing the top plug 470 to move down to seat and seal on the bottom plug 460 (with the flow tube 441 moved up into the top plug 470), to stop fluid flow up into the annulus. The can 422 may be located and secured at any point in the casing. In one aspect it hangs on a casing hanger. The plugs, plug retainers, and flow tube of the plug set 420 may all be made of plastic, of fiberglass, and/or easily drillable material; as also may be the can, ball(s), and/or dart(s) used therewith. Sealing O-rings 485, 487 are provided for the dart 480.

Figure 27:
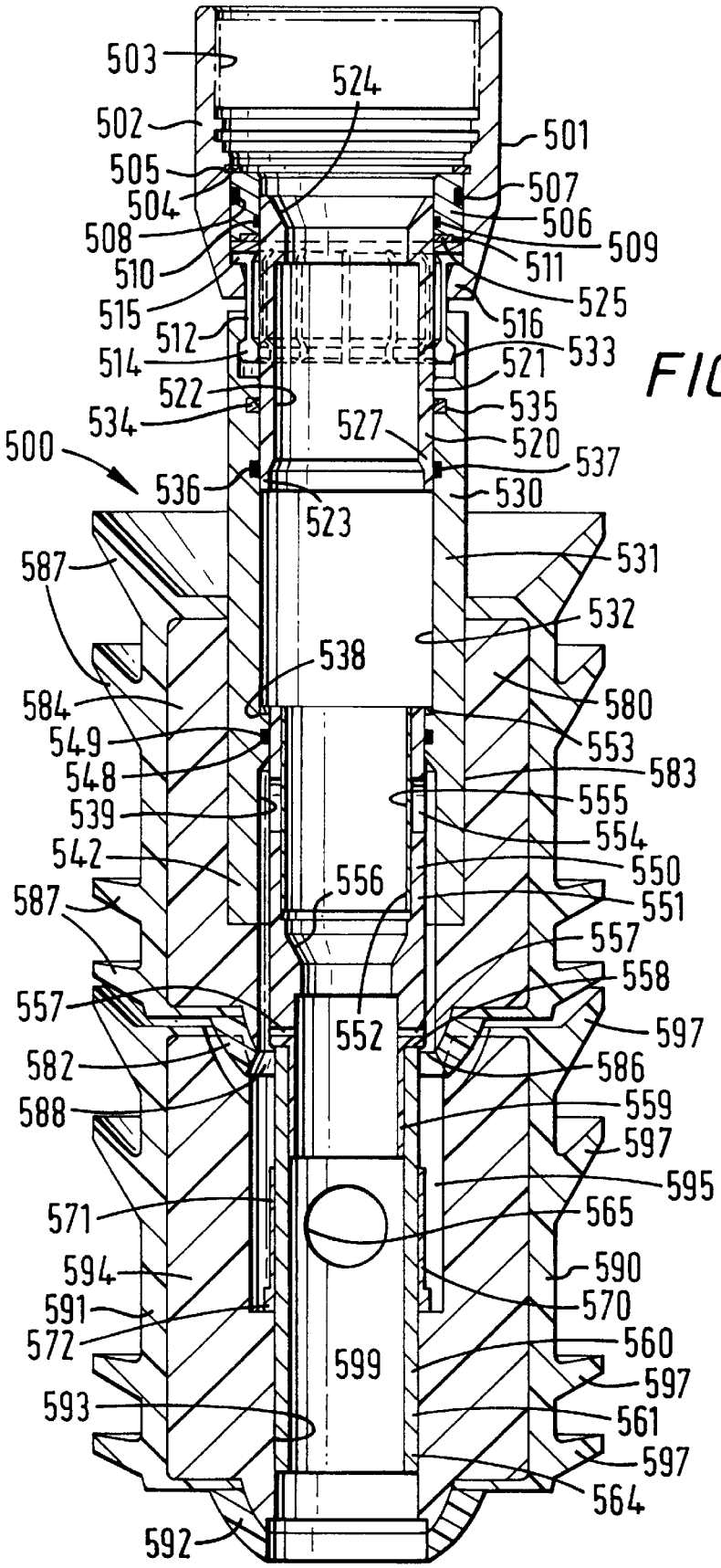
FIG. 27 is a side cross-section view of a plug system according to the present invention.

Referring now to FIG. 27, a system 500 according to the present invention has a top crossover sub 501 made e.g. of metal, e.g. steel. The sub 501 has a body 502 with a central flow bore 503 extending therethrough from one end to the other. A snap ring 504 in a recess 505 holds a seal ring 506 in place against part (an upper shear ring) of a top dart receiver 520.

The seal ring 506 has an O-ring 507 in a recess 508 to seal the interface between the seal ring's exterior and the body's (502) interior; and an O-ring 509 in a recess 510 seals the interface between the seal ring and an exterior surface of the top dart receiver 520. A recess 511 accommodates an upper shear ring 525 of the top dart receiver 520. A plurality of collets 512 extend from a main collet ring 515 out from a lower end 516 of the sub 501 each terminating in a bottom collet member 514. (The shear ring 525, and any shear ring herein, may be a complete circular ring or it may include only portions thereof; e.g. three fifty degree portions spaced apart by seventy degree voids. Any shear ring may be grooved or indented to facilitate rupture or shearing.)

Initially the bottom collet members 514 are disposed in a collet groove 533 of a top plug cylinder 530 and are held therein by the exterior surface of the top dart receiver 520. The top dart receiver 520 has a body 521 with a fluid flow bore 522 extending therethrough from one end to the other. An upper end 526 of the top dart receiver has the upper shear ring 525 projecting therefrom into the recess 511 of the upper seal ring 506. The upper shear ring 525 initially rests on the top of the main collet ring 515 thereby holding the top dart receiver within the sub 501 with a lower end 527 thereof projecting into the top plug cylinder 530. The top dart receiver 520 has a lower lip 523 which, after dart receipt within the top dart receiver 520, rests on an inner shoulder 538 of the top plug cylinder 530. The top dart receiver has an upper seat surface 524 against which rests and seals part of a top dart.

The top plug cylinder 530 has a body 531 with a flow bore 532 extending therethrough from one end to the other end. A retainer ring 534 rests in a recess 535. The retainer ring 534 is released when the top dart receiver 520 moves downwardly in the top plug cylinder 530 past the ring 534. Then the ring 534 contracts to prevent the top dart receiver 520 from moving back up within the top plug cylinder 530. An O-ring 536 in a recess 537 seals the top dart receiver-top plug cylinder interface.

The top plug cylinder 530 is held within a central fluid flow bore 583 of a top plug 580, e.g. by any suitable fastener or adhesive, e.g. epoxy adhesive. The top plug cylinder 530 may be made of any suitable metal, ceramic, cement, composite, plastic or fiberglass material, as may each component of the system 500. In one particular embodiment the top plug cylinder 530 is made of composite plastic or of alumunum, a core 584 of the top plug 580 is made of filled urethane or phenolic plastic material, and epoxy adhesive holds the two together. In one aspect, a top plug cylinder (e.g., made of plastic, fiberglass, or metal; made of, e.g., PDC-drillable material) is molded into a plug core (e.g., a core of filled urethane, urethane or phenolic material) during the plug molding manufacture process.

An O-ring 549 in a recess 548 seals the interface between the interior of the top plug cylinder 530 and an exterior surface of a top part of a bottom dart receiver 550. A recess 539 is formed in a lower end 542 of the body 531.

The bottom dart receiver 550 has a body 551 with a fluid flow bore 552 extending therethrough from one end to the other. An upper shear ring 553 secured to or formed integrally of the body 551 projects out from the body 551 and initially rests on the shoulder 538 of the top plug cylinder 530. This can be a segmented shear ring of less than three hundred sixty degrees in extent and/or it can be grooved, cut, or indented to facilitate breaking. Initially a secondary burst sleeve 555 blocks fluid flow through a port 554. As a fail safe measure, more than one port can be provided, with the weakest being the one to open. The sleeve 555 is held in place by a friction fit, by an adhesive, by thermal locking, or fusion, or some combination thereof. In one aspect, the sleeve 555 is made of aluminum, e.g. 0.0175 inches thick to burst at a fluid pressure of 1026 p.s.i. In one aspect such a sleeve is made by using two hollow cylindrical aluminum members, heating one, cooling the other, then inserting the cooled member into the heated member. As the two members reach ambient temperature they are firmly joined as the heated member cools to shrink onto the cooled member and the cooled member expands against the cooled heated member. In one aspect the port is covered by a portion of the sleeve at which the two pieces of aluminum overlap. In another aspect a single molded piece is used.

The bottom dart receiver 550 has an inner seating surface 556 against which rests and seats a sealing face of a bottom dart. A lower shoulder 558 of the body 551 rests on bottom plug cylinder 560. Fluid pressure equalization ports 557 (one, two, three or more) extend through the body 551 and permit fluid flow from within the bottom dart receiver to an interior space 588 within the nose 582 and from there to space between the top plug 580 and bottom plug 590 so that the two plugs in place in a wellbore (in place beneath the surface from which a wellbore extends down) do not vacuum lock together due to the hydrostatic pressure of fluids on the two plugs pushing them together.

The bottom dart receiver 550 has a lower end 559 that projects down into a bottom plug cylinder 560 that extends from a top of the bottom plug 590 to a point near the plug's bottom above a nose 592. The plug 590 has a body 591 with a core 594 and a central fluid flow bore 593. The bottom plug cylinder 560 has a body 561 with a hole 565 therethrough (more than one hole may be used) and a lower end 564.

A primary burst tube 570 with a body 571 encircles part of the bottom plug cylinder 560 and, initially, blocks fluid flow through the hole 565. An enlarged lower end 572 rests on an inner shoulder 599 of the bottom plug 590. This enlarged end facilitates correct emplacement of the tube 570 on the cylinder 560 and hinders the extrusion of the burst out from within the bottom plug 590 between the exterior of the cylinder 560 and the inner surface of the bore 593.

In one typical operation of the system 500 a ball or a bottom dart free falls or is pumped down and is received within the bottom dart receiver 550, seating against the seat surface 556. As pressure builds up, the upper shear ring 553 shears (e.g. at about 1600 p.s.i.), releasing the bottom dart receiver 550 and bottom plug 590. This combination moves down in a cased wellbore, e.g. to contact float equipment already positioned in the wellbore at a desired location. The dart seated on the seating surface 556 and the intact burst tube 570 prevent fluid from flowing through the bore 593 of the bottom plug 590. Once the bottom plug 590 is positioned and seated as desired, fluid pressure (e.g. cement, water, drilling fluid, mud) is increased and fluid flows down in an interior space 595 and, when a desired pressure is reached, e.g. about 700 to about 800 p.s.i., the burst tube 570 bursts at the hole 565 permitting fluid to flow through the plug to the float equipment.

When it is desired to launch the top plug 580, a top dart is introduced into the string above the sub 501 and is pumped down so that the dart seats on the seating surface 524 of the top dart receiver 520. When fluid pressure then reaches a sufficient level, e.g. about 1200 p.s.i., the upper shear ring 525 shears releasing the top dart receiver 520 from the sub 501 and pushing the top dart receiver 520 down in the top plug cylinder 530. This frees the bottom collet members 514, releasing the top plug cylinder 530 and the top plug 580. The top dart prevents fluid flow through the top plug bore 583 and fluid pressure moves the top plug 580 down to contact the bottom plug 590. The top plug bore 583 is sized and configured to receive the bottom dart receiver 550. The nose 582 of the top plug contacts and seals against the bottom plug. Previously described anti-rotative structure may be used with the top plug, bottom plug, and float equipment.

If for some reason the top plug 580 launches with the bottom plug 590, bursting of the secondary burst tube 555 provides a fluid flow path thorugh the two-plug combination which would not normally be possible with the top plug seated on the bottom plug and a top dart blocking flow thorugh the top plug. For example, if the bottom plug is inadvertently pumped down too fast with too much momentum when it hits the bottom plug the force may be sufficient to break the collet members 514, launching the two plugs together. In such a situation the secondary bursting tube acts as a pressure spike or pulse relief system and, although the two plugs launch together, a cementing operation can still be commenced. E.g., when pumping a bottom dart down at a high rate, e.g. rates exceeding 2 barrels per minutes (84 gallons per minute) or dart velocity exceeding 7 feet per second, a pressure pulse or spike is created, e.g. as high as 2,300 p.s.i. Such a pulse may last one second, a half second, a fifth of a second, or three hundreths of a second or less. In one situation such a high pressure was recorded over a lapse time of 2/100 of a second on large plugs for pipe 12.25" and larger. The reason for these pressure pulses or spikes is because the bottom dart is moving at a high velocity and the bottom plug is stationary. The dart receiver in the bottom plug catches the dart, stopping its movement, and the pump pressure and fluid momentum behind the dart cause the pressure spike or pulse. The size of the spike or pulse is limited to the strength of the bursting tube, thus protecting the internal plug mechanism from excessive pressure. Once the pulse is relieved through the blown rupture tube, pump pressure is then applied to the entire top of the bottom plug. This pressure causes the bottom plug to start moving and separate from the top plug by shearing the bottom dart receiver away from the top plug. However, the required shear pressure, typically less than 200 p.s.i., applied to the entire top of the bottom plug is much less than the pressure required to burst the primary plastic rupture tube, typically 700 to 800 p.s.i. Thus the bottom plug is launched properly, even though the bottom plug releasing dart is pumped down at an excessive rate causing a pressure spike or pulse that could damage a plug mechanism not equipped with the secondary bursting tube. Each plug 580, 590 has a series of wipers and/or fins 587, 597 respectively.

In one aspect the bottom plug cylinder is fiberglass and the bottom dart receiver is plastic, fiberglass, or aluminum; and the two are secured together with a suitable adhesive, e.g. epoxy. In one aspect, the secondary burst tube has a body made of plastic, fiberglass or composite with a portion made of aluminum. This portion is sized to overlap the port(s) 554 in the bottom dart receiver. In one aspect the top dart receiver is made from aluminum and, in one aspect, the bottom dart receiver is made from aluminum.

Figure 29:
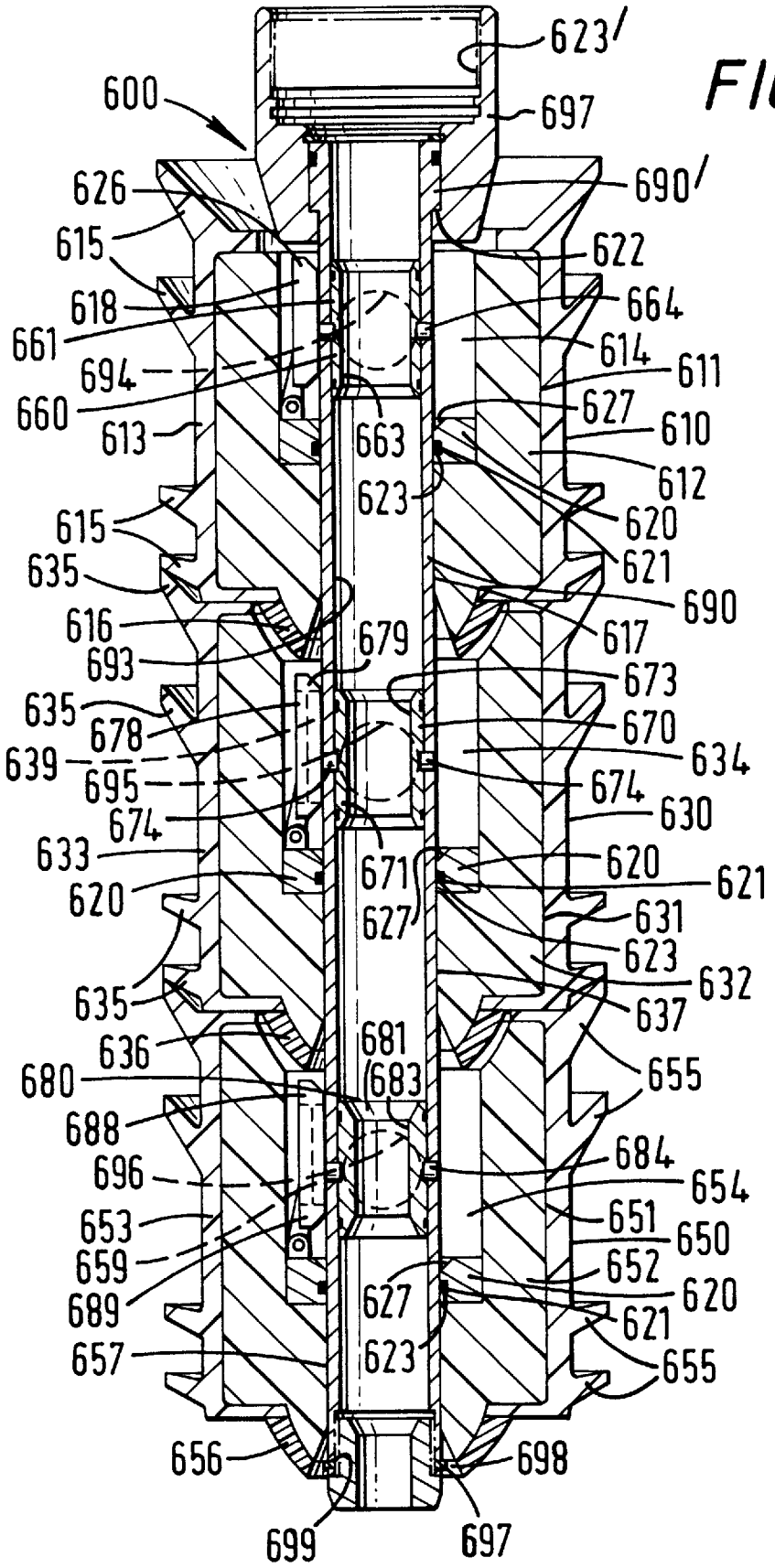
FIG. 29 is a side cross-section view of a plug system according to the present invention.

Referring now to FIG. 29, a system 600 according to the present invention has a series of three plugs 610, 630 and 650 interconnected by a central flow tube 690 and associated apparatus. The flow tube 690 has an upper shoulder 699 which rests on a corresponding shoulder 622 of a top sub 697. The top sub 697 has a fluid flow bore 623 extending from one end thereof to the other and which is in fluid communication with a fluid flow bore 693 of the flow tube 690.

The plug 610 has a body 611, a core 612, and outer structure 613 with a plurality of fins and/or wipers 615 and a central chamber 614, and a fluid flow bore 617 which extends from a top end of the plug to a bottom end thereof. A nose 616 is disposed at the end of the plug (like the noses previously described herein). A shear ring 697 in a recess 698 of the plug 650 and a recess 699 of the tube 690 initially holds the plug 650 to the tube 690.

Adjacent a hole 694 of the tube 690 is a releasable sleeve 660 which is initially held in place blocking fluid flow through the hole 694 by one or more shear pins 664. The sleeve 660 has a body 661 with a fluid flow bore 663 extending therethrough from a top end to a bottom end of the sleeve 660. A ring 620 in the chamber 614 has an O-ring 621 in a recess 623 sealing the tube 69O-ring 620 interface.

A flapper valve 618 is initially held open by the tube 690. Once the plug 610 is separated from the tube 690, the flapper valve 618 is free to close, i.e., a valve member 626 seats against a seating surface 627 of the ring 620 preventing fluid flow through the plug 610.

The plug 630 has a body 631, a core 632, and outer structure 633 with a plurality of fins and/or wipers 635, a central chamber 634 and a fluid flow bore 637 which extends from a top end of the plug to a bottom end thereof. A nose 636 is disposed at the end of the plug (like the noses previously described herein).

Adjacent a hole 695 of the tube 690 is a releasable sleeve 670 which is initially held in place blocking fluid flow through the hole 695 by one or more shear pins 674. The sleeve 670 has a body 671 with a fluid flow bore 673 extending therethrough from a top end to a bottom end of the sleeve 670. A ring 620 in the chamber 634 has an O-ring 621 in a recess 623 sealing the tube 69O-ring 620 interface.

A flapper valve 678 is initially held open by the tube 690. Once the plug 630 is separated from the tube 690, the flapper valve 678 is free to close, i.e., a valve member 679 seats against a seating surface 627 of the ring 620 preventing fluid flow through the plug 630, i.e. once the plug 630 is launched off the tube 690.

The plug 650 has a body 651, a core 652, and outer structure 653 with a plurality of fins and/or wipers 655, a central chamber 654, and a fluid flow bore 657 which extends from a top end of the plug to a bottom end thereof. A nose 656 is disposed at the end of the plug (like the noses previously described herein).

Adjacent a hole 696 of the tube 690 is a releasable sleeve 680 which is initially held in place blocking fluid flow through the hole 696 by one or more shear pins 684. The sleeve 680 has a body 681 with a fluid flow bore 683 extending therethrough from a top end to a bottom end of the sleeve 680. A ring 620 is in the chamber 654 and has an O-ring 621 in a recess 623 sealing the tube 69O-ring 620 interface.

A flapper valve 688 is initially held open by the tube 690. Once the plug 650 is separated from the tube 690, the flapper valve 688 is free to close, i.e., a valve member 689 seats against a seating surface 627 of the ring 620 preventing fluid flow through the plug 650.

The lowest plug 650 and the middle plug 630 each have a rupture disk diaphragm 639, 659 respectively, in their respective valve members which is designed to rupture in response to a set fluid pressure so that selective fluid flow through the valve member and hence through the plugs is possible.

The present invention in certain embodiments, discloses apparatus as described above but which does not use an integral cylindrical sleeve to control flow through a hole or port, but which uses a portion of a sleeve (e.g. a half-sleeve or a third of a sleeve) or uses a patch or piece of material covering the hole or port. Such a patch or piece is secured over the hole or port, adhered over it with an adhesive, bonded or welded over it, or thermally fused over it (as may be any of the sleeves described above).

The present invention, in one aspect, discloses apparatus with a hole or port and one of the sleeves, patches, or pieces of material as described above to provide selective opening of the port with fluid at a desired pressure. Such apparatus may be used in any downhole or wellbore tool, system or apparatus in which selective hole or port opening is desired.

Figure 28:
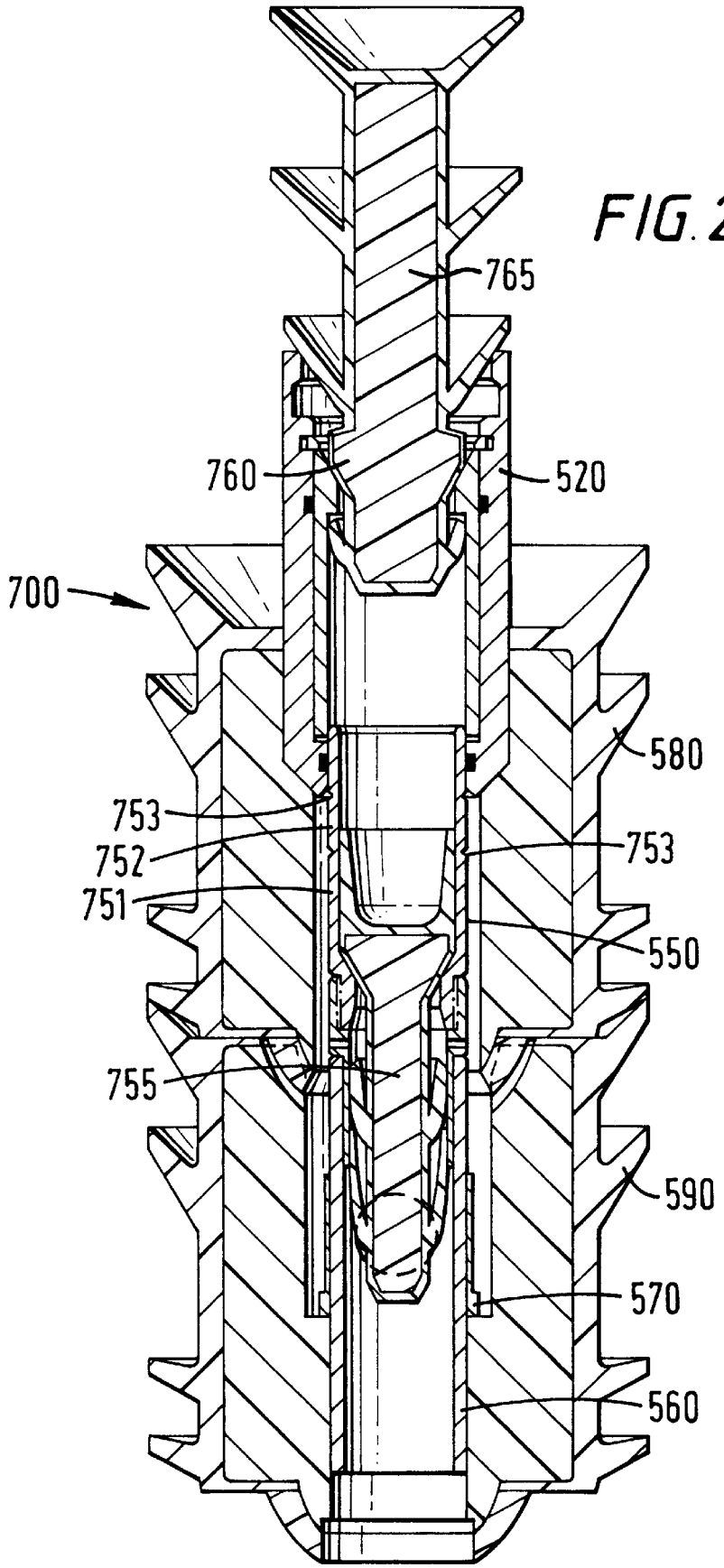
FIG. 28 is a side cross-section view of a plug system according to the present invention.

Referring now to FIG. 28 a system 700 (like the system 500 with like numerals indicating like structure) has a bottom dart receiver 550 which does not have a secondary burst sleeve 555, but does have a body 751 with a weakened area 752 which bursts in response to fluid at a desired pressure. Weakening is provided by a circular notch 753 in the wall of the body 751 which defines a circle on the wall of the body 751; but any known weakening structure—grooves, indentations, cuts, etc.—may be used. Two circular weakened areas are shown, but one or more than two may be used; i.e. one or more possible ports may be provided. Once the weakened area is burst, a flow port is provided for downward fluid flow which was previously blocked by a lower dart 755 sealing off flow through the bottom plug 590. A seated shoulder 760 of a top dart 765 seals off flow through the top plug 580.

In the event that a top plug launches with a bottom plug in a system according to the present invention, and fluid at relatively high pressure, e.g. 2300 p.s.i., is then applied into the top plug and then to the bottom dart receiver, the secondary burst sleeve (or weakened area or partial sleeve or patch) bursts and, therefore, fluid flow through the newly-created opening is possible, e.g. so cementing can continue and cement can continue to flow into an annulus between the inside wall of the wellbore and the exterior wall of the tubular or casing in which the plugs are located.

It is within the scope of this invention for any plug set according to this invention to be made (in its entirety or substantially all of it) of plastic, fiberglass, polytetrafluoroethylene, or any easily drillable metal (brass, beryllium, copper, copper-based alloy, zinc, zinc-based alloy) or non-metal material. It is within the scope of this invention to delete the bottom plug from any plug set disclosed or claimed herein to provide a single plug system. It is within the scope of this invention to make the top sub of any plug set disclosed or claimed herein (and any lock ring, such as the lock ring 374; any holding ring, such as the holding ring 376; and any collet member) of appropriate material (e.g. plastic, metal, fiberglass) so that these items are re-usable once they have been retrieved from a wellbore.

Figure 30A:
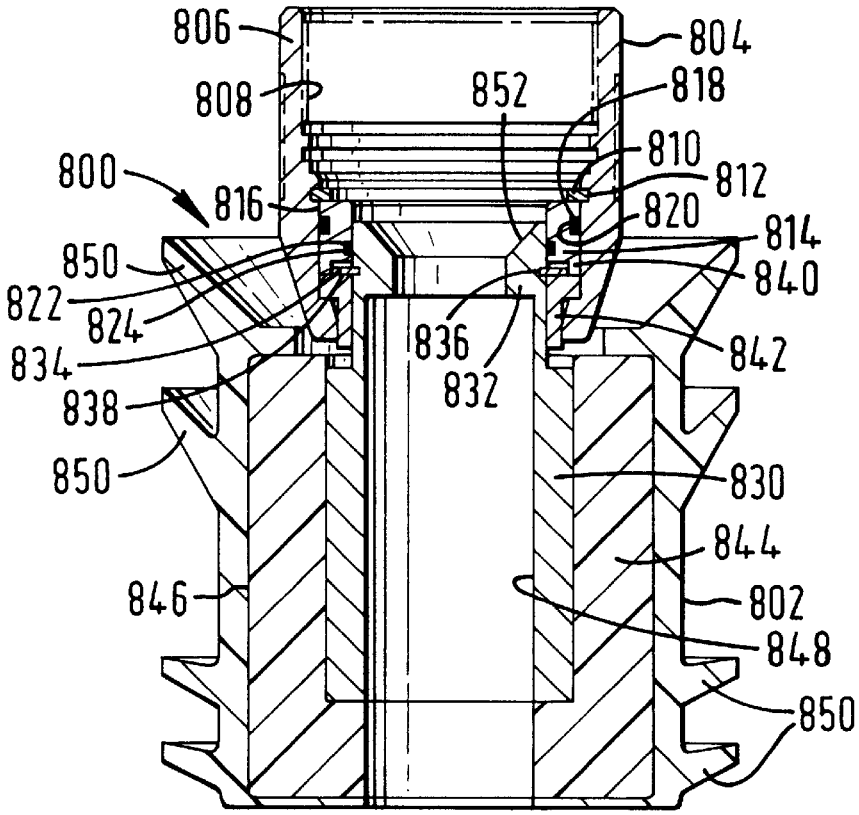
FIG. 30A is a side cross-section view of a plug system according to the present invention.

FIG. 30*a* shows a plug system 800 according to the present invention with a plug 802 and a top sub 804 connected thereto. The top sub 804 connected thereto. The top sub 804 has a body 806 with a fluid flow bore 808 therethrough. A snap ring 810 in a groove 812 holds a seal ring 814 in place in a groove 816. An O-ring 818 in a recess 820 seals a ring-sub interface. An O-ring 822 in a recess 824 seals a ring-dart receiver interface.

A dart receiver 830 has a top end 832 held in the top sub 804 by a shear snap ring 834 which has one portion extending into a recess 836 in the top dart receiver 830 and one portion in a recess 838 of the seal ring 814. The seal ring 814 has a lower lip 840 resting on a member 842 and the shear snap ring 834 rests on the member 842.

The dart receiver 830 is glued or otherwise secured with fasteners to a core 844 of the plug 802. The plug 802 has a body 846 and a flow bore 848 therethrough. A plurality of wipers and/or fins 850 are on the body 846. To separate the dart receiver (and thereby the plug 802) from the top sub 804, a ball or dart is dropped and-or pumped and seated on a seating sealing surface 852 of the dart receiver. Build up of hydrostatic pressure on the shear snap ring 834 breaks ears extending from the ring, thereby freeing the dart receiver to separate from the top sub 804. In one aspect the system 800 is useful as a "top plug only" system and the plug 802, in one aspect, may be a typical top plug bored out to receive the dart receiver. In one aspect the system 800 is made from PDC—drillable material, e.g., but not limited to, plastic. Such plugs may be used with high hydrostatic pressures, e.g. above 4000 p.s.i., up to 12000 p.s.i. and more. Although the plug 802 has a flow bore through it, it may be used as a top plug.

Figure 30B:
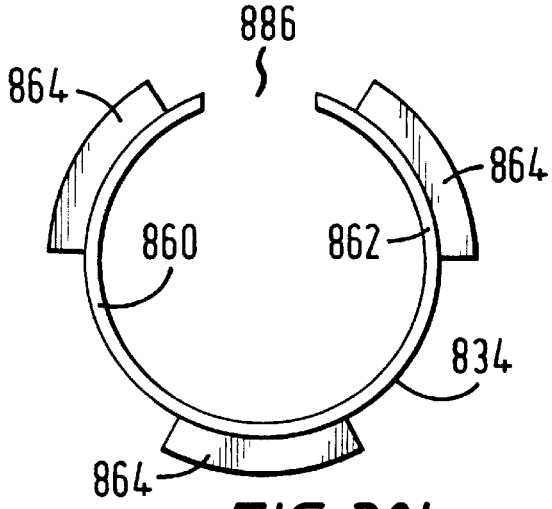
FIG. 30B is a top view of a shear ring of the system of FIG. 30A.
Figure 30C:
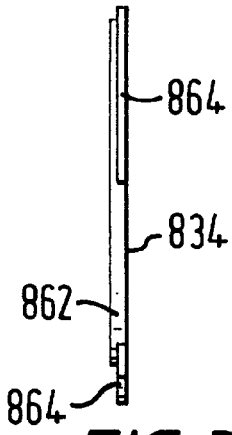
FIG. 30C is a side view of the ring of FIG. 30B.

As shown in FIGS. 30B and 30C, the shear snap ring 834 has a body 860 with a ring portion 862 and a plurality of shearable ears 864. An opening 866 permits emplacement of the ring around a tubular or cylindrical member (such as a dart receiver) when the ring is made of material which permits spreading of the ring for such emplacement (e.g. plastic, fiberglass, composite plastic, etc.). One or more ears of any desired size and extent may be employed.

Figure 31A:
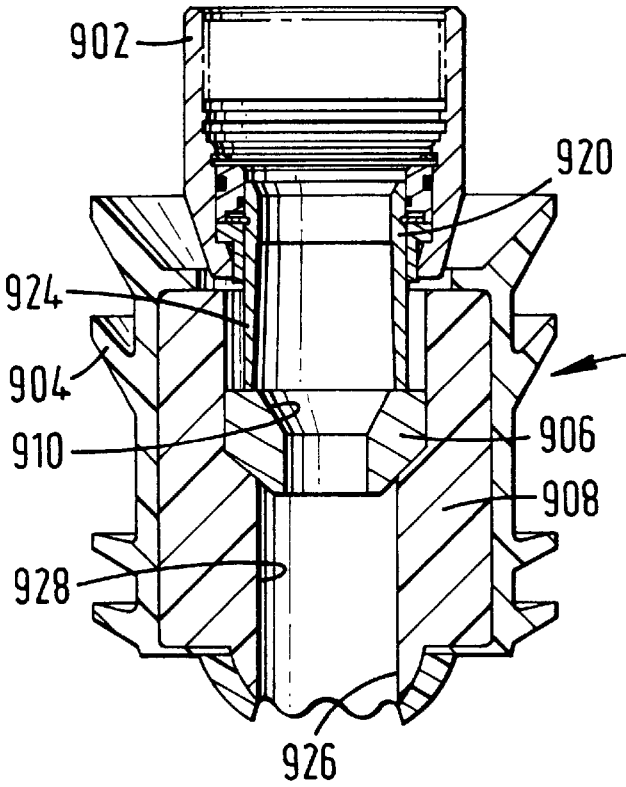
FIGS. 31A and 31B are side cross-section views of a system according to the present invention.
Figure 31B:
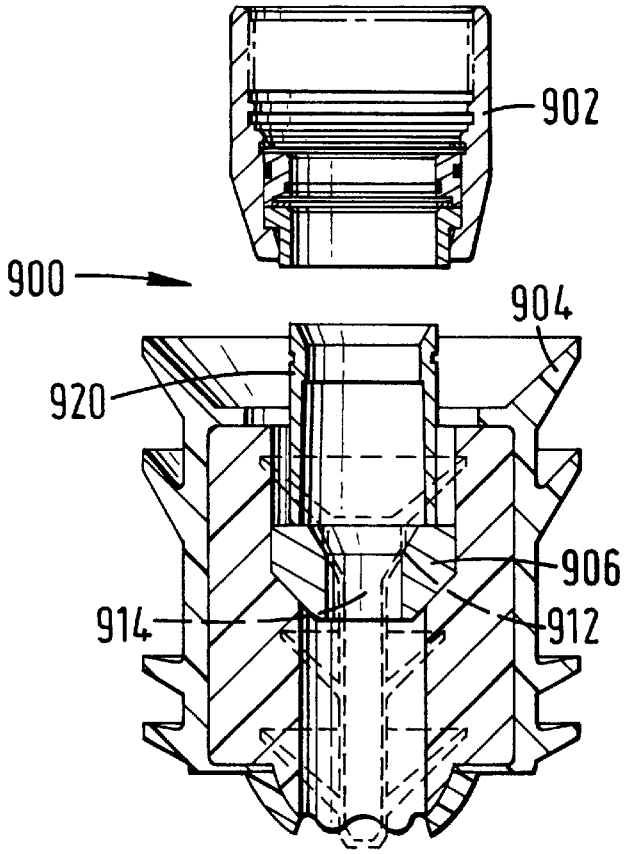

FIGS. 31A and 31B show a system 900 according to the present invention with a top sub 902 and a plug 904. The plug 904 has a bottom dart receiver 906 made integral with a core 908 of the plug. The bottom dart receiver 906 has a seating sealing surface 910 against which a shoulder 912 of a plug 914 (see FIG. 31B) may seat and seal to effect a hydrostatic pressure build up to separate a top dart receiver 920 from the top sub 902. The mechanism to permit selective separation of the top dart receiver 920 from the top sub 902 is like that of the dart receiver 830 of FIG. 30A. The top dart receiver 920 has a lower portion 924 glued or secured to the bottom dart receiver 906. A lower portion 926 of a flow bore 928 extending through the plug 904 may be tapered to facilitate removal from a mold.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A plug set for wellbore operations comprising a top plug, comprising a top plug body having a top and a bottom, the top plug body with a fluid flow bore therethrough from top to bottom and a closure sleeve within the fluid flow bore that initially prevents fluid flow through the fluid flow bore, the closure sleeve having a rupture area ruptureable in response to fluid at a minimum rupture pressure so that the introduction of fluid to the top plug at a pressure at least equal to said minimum pressure ruptures the area so that fluid is flowable through the top plug, and a bottom plug releasably secured to the top plug.

2. The plug set of claim 1 wherein the closure sleeve is made of metal.

3. The plug set of claim 2 wherein the closure sleeve is made of aluminum.

4. The plug set of claim 1 wherein the rupture area is an area weakened to rupture at a pressure at least equal to the minimum rupture pressure.

5. The plug set of claim 1 further comprising the top plug having a cylinder within the fluid flow bore, the cylinder having a fluid flow port therethrough through which fluid is flowable into a space between an exterior of the cylinder and an interior surface defining the fluid flow bore to exit from the bottom of the top plug, the closure sleeve initially blocking fluid flow through the fluid flow port of the cylinder, the rupture area of the closure sleeve disposed adjacent the fluid flow port so that upon rupture of the rupture area fluid is flowable through the top of the top plug, through the fluid flow port and out through the bottom of the top plug.

6. The plug set of claim 5 wherein the closure sleeve is made of material with a thickness such that whatever portion of the closure sleeve is the rupture area said rupture area is rupturable at a pressure at least equal to the minimum rupture pressure.

7. The plug set of claim 6 wherein the closure sleeve comprises a first aluminum sleeve held by thermal locking within a second aluminum sleeve, a portion of the first aluminum sleeve overlapping the second aluminum sleeve defining an overlap area, the rupture area comprising a portion of the overlap area.

8. The plug set of claim 1 further comprising a dart receiver releasably connected to the top plug and secured to the bottom plug so that fluid under at least a minimum separation pressure flowing through the fluid flow bore of the top plug releases the dart receiver from the top plug so that the bottom plug is separable from the top plug.

9. The plug set of claim 8 wherein the minimum rupture pressure is greater than the minimum separation pressure.

10. The plug set of claim 1 wherein the plug set is made of drillable material.

11. The plug set of claim 1 further comprising a pressure equalizer for relieving fluid pressure on top of the top plug, the pressure equalizer connected to and above the top plug and comprising a hollow body with a top and a bottom, the hollow body connectible to a tubular string in a wellbore, the hollow body having a primary fluid flow bore therethrough from top to bottom, the hollow body having a secondary fluid flow bore therein, the secondary fluid flow bore having a top end in fluid communication with the primary fluid flow bore and a bottom end in fluid communication with space exterior to the hollow body and above the top plug, valve apparatus in the secondary flow bore movable in response to fluid under pressure in the space exterior to the hollow body and above the top plug to permit fluid under pressure to flow from the space exterior to the hollow body through the secondary fluid bore, and into the primary fluid bore, thereby relieving fluid pressure above the top plug, and a swivelling sub sealingly connected below the hollow body between the hollow body and the plug set so that the plug set is rotatable with respect to the hollow body.

12. A plug set for wellbore operations comprising a top plug, comprising a top plug body having a top and a bottom, the top plug body with a fluid flow bore therethrough from top to bottom and a closure sleeve within the fluid flow bore that initially prevents fluid flow through the fluid flow bore, the closure sleeve having a rupture area ruptureable in response to fluid at a minimum rupture pressure so that the introduction of fluid to the top plug at a pressure at least equal to said minimum pressure ruptures the area so that fluid is flowable through the top plug, and a bottom plug releasably secured to the top plug, the top plug having a cylinder within the fluid flow bore, the cylinder having a fluid flow port therethrough through which fluid is flowable into a space between an exterior of the cylinder and an interior surface defining the fluid flow bore to exit from the bottom of the top plug, the closure sleeve initially blocking fluid flow through the fluid flow port of the cylinder, the rupture area of the closure sleeve disposed adjacent the fluid flow port so that upon rupture of the rupture area fluid is flowable through the top of the top plug, through the fluid flow port and out through the bottom of the top plug, the closure sleeve made of material with a thickness such that whatever portion of the closure sleeve is the rupture area said rupture area is rupturable at a pressure at least equal to the minimum rupture pressure, the closure sleeve comprising a first aluminum sleeve held by thermal locking within a second aluminum sleeve, a portion of the first aluminum sleeve overlapping the second aluminum sleeve defining an overlap area, the rupture area comprising a portion of the overlap area, a dart receiver releasably connected to the top plug and secured to the bottom plug so that fluid under at least a minimum separation pressure flowing through the fluid flow bore of the top plug releases the dart receiver from the top plug so that the bottom plug is separable from the top plug, and the minimum rupture pressure is greater than the minimum separation pressure.

* * * * *